US009352324B2

(12) United States Patent
Rethwisch et al.

(10) Patent No.: US 9,352,324 B2
(45) Date of Patent: May 31, 2016

(54) CARRIER FOR PIPETTE TIPS

(71) Applicant: Eppendorf AG, Hamburg (DE)

(72) Inventors: Hanna Rethwisch, Hamburg (DE); Michael Blumentritt, Hamburg (DE)

(73) Assignee: Eppendorf AG, Hamburg (DE)

( * ) Notice: Subject to any disclaimer, the term of this patent is extended or adjusted under 35 U.S.C. 154(b) by 0 days.

(21) Appl. No.: 13/970,939

(22) Filed: Aug. 20, 2013

(65) Prior Publication Data

US 2013/0336852 A1 Dec. 19, 2013

Related U.S. Application Data

(63) Continuation-in-part of application No. 12/691,198, filed on Jan. 21, 2010, now Pat. No. 8,591,840.

(60) Provisional application No. 61/146,818, filed on Jan. 23, 2009.

(51) Int. Cl.
*B01L 9/06* (2006.01)
*B01L 9/00* (2006.01)

(52) U.S. Cl.
CPC ..... *B01L 9/543* (2013.01)

(58) Field of Classification Search
CPC ..... B01L 9/543
USPC ..... 422/564
See application file for complete search history.

(56) References Cited

U.S. PATENT DOCUMENTS

| | | | | |
|---|---|---|---|---|
| 5,366,088 | A | 11/1994 | Hill et al. | |
| 5,392,914 | A * | 2/1995 | Lemieux et al. | 206/499 |
| 6,221,317 | B1 | 4/2001 | Carl | |
| 6,286,678 | B1 | 9/2001 | Petrek | |
| 6,534,015 | B1 | 3/2003 | Viot et al. | |
| 2006/0045815 | A1 * | 3/2006 | Hovatter | 422/104 |
| 2010/0266457 | A1 | 10/2010 | Rethwisch et al. | |

FOREIGN PATENT DOCUMENTS

| | | |
|---|---|---|
| EP | 2210668 | 7/2010 |
| WO | 00/51899 | 9/2000 |

* cited by examiner

*Primary Examiner* — Paul Hyun
(74) *Attorney, Agent, or Firm* — Vidas, Arrett & Steinkraus, P.A.

(57) ABSTRACT

A carrier comprising pipette tips with a frame or box having four side walls, several plates with a plurality of holes, pipette tips inserted into the holes, a circumferential edge protruding from each plate and a circumferential resting edge of the upper edge of the frame or box defining locking elements for releasably connecting the frame or box with a lower plate, a distance piece formed from a single piece of material placed with a bottom side on the lower plate or on the pipette tips in the lower plate and an upper plate which is supported with the bottom side on the top side of the distance piece, the upper plate and the lower plate being part of the several plates, wherein the distance piece has an intermediate bottom with a plurality of additional holes for the lateral guiding of pipette tips held in the upper plate.

17 Claims, 23 Drawing Sheets

Detail "Z"

CARRIER FOR PIPETTE TIPS

CROSS-REFERENCE TO RELATED APPLICATIONS

This application is a Continuation-in-Part of U.S. patent application Ser. No. 12/691,198, filed on Jan. 20, 2010, which claims the benefit of U.S. Provisional Patent Application Ser. No. 61/146,818, filed on Jan. 23, 2009, which is incorporated herein by reference in its entirety.

BACKGROUND OF THE INVENTION

The present invention is related to a carrier for pipette tips, for those in automatic machines in particular. Furthermore, the invention relates to a distance piece for holding an upper plate with a plurality of holes for inserting pipette tips spaced from a lower plate with a plurality of holes for holding pipette tips.

Carriers for pipette tips serve for keeping and providing pipette tips made of plastic material for utilisation. They have an edge with four upwardly projecting side walls and a plate, disposed on the upper edge of the frame and having a plurality of holes in a matrix arrangement. Pipette tips are put into the holes from out the upside, wherein they do not fall through the holes due to a diameter that widens towards the upside, or due to a collar. The frame is adapted to be put onto a support with its lower edge or a bottom. The pipette tips are held at a distance from the support by the carrier. One or plural pipette tips may be taken out of the carrier by means of a pipetting- or metering apparatus, respectively. For this purpose, the metering apparatus is pressed into the upper opening of one or plural pipette tips with one or plural studs. After use, the pipette tips are normally put into a carrier or given off into a container with the aid of a throw-off device of the metering apparatus, in order to be disposed of.

Carriers for pipette tips are known wherein the frame is covered by a bottom at the downside, and by a detachable cover cap on the upside. In these box-like carriers, the pipette tips are protected against contaminations. Before taking out pipette tips, the cover cap has to be removed.

From WO 00/51899 A1, a refill package for re-usable carriers for pipette tips is known. The refill package comprises a plate with holes in a matrix arrangement, into which pipette tips are inserted, and a flexible cover cap in which the plate is held. When putting the cover cap onto the upper edge of a carrier, the side walls of the cover cap are laterally deflected, so that the plate clamped in there between is released. As a consequence, the plate with the pipette tips falls into a reception piece of the carrier that is surrounded by an enclosure. Refilling the carrier with pipette tips and taking out the plate with pipette tips from the carrier are performed manually.

In automatic metering machines and automatic laboratory machines ("workstations") that include metering apparatuses, pipette tips made of plastic material are frequently employed. Automatic metering machines and automatic laboratory machines will be designated as "automatic machines" in the following. The known refill package is not well suited for the utilisation in automatic machines. Displacement of the cover cap by an automatic machine in order to separate plate and cover cap would be problematic due to the cover cap's flexibility. When the plate is disposed in the carrier, the lateral enclosure encumbers the removal by an automatic machine.

From U.S. Pat. No. 6,221,317 B1, a box for pipette tips is known which features a lower part with a bottom and side walls, which end up in support surfaces at the upside. A plurality of locking elements is asymmetrically disposed on the support surfaces. A plurality of inner walls projecting upward from the bottom is adjacent to a plurality of inner accommodations. A plate portion features a first set of holes, into which the locking elements are inserted. Further, it has a second set of holes for the insertion of pipette tips. The locking elements are realised as locking pins, which engage by frictional fit into the first set of holes of the plate. Thus, plate and lower part are detachably fixed to each other by way of the pins and bores. However, detaching the plate from the lower part is only possible by the expenditure of a force that is greater than the weight force of lower part and plate. The user can choose among plates having 96, 348 an 1536 holes for inserting pipette tips. He can fix the selected plate on the lower part by way of the locking pins and the holes. Thereafter, he may insert the pipette tips into the holes and place a cover cap over the plate.

The grid-like subdivision of the interior space provides the box with a stiffness sufficient for handling by an automatic machine. Automatic refilling of pipette tips into the box would be a problem. In particular, replacing a plate by a plate equipped with new syringes would be hard to perform for an automatic machine. That is to say, this would require a very accurate positioning of the holes above the locking pins that must be pressed in, and an accurate insertion of the pipette tip into the interior space that is subdivided by inner walls. This could not be managed by conventional automatic machines. Thus, it is a disadvantage of such a box that the pipette tips hit the grid-like subdivision when being inserted, and fall out of the plate. From this document, it is also known to stack several pipette tip boxes on top of each other in order to combine a larger number of pipette tips. This arrangement requires much space and material.

The sales unit with refill packages for nestable pipette tips Tip One® from the company USA Scientific comprises pipette tips, which are arranged in plates stacked on top of each other, wherein the pipette tips are inserted into each other. The lowermost plate is inserted into a box and the uppermost plate is covered with a cover. In order to remove pipette tips by means of a pipette, a plate is removed from the stack and inserted into a box. This system saves space and material. However, it is only suitable for nestable pipette tips. Nestable pipette tips are pipette tips that are nestable due to complementary inner and outer shapes, in particular inner and outer conical shapes with the same opening angle. The system is not suitable for non-nestable pipette tips, in particular for pipette tips with a cylindrical section and for filter pipette tips, because they are only partially nestable and hereby wedge together easily or hit the filter. As a result, during removal of an upper plate, pipette tips from a lower plate would be taken along or respectively the function of the filter pipette tips would be impaired.

From U.S. Pat. No. 5,366,088, a carrier for pipette tips is known, which has five racks stacked one above the other. Each rack comprises a plate with a plurality of holes for removing pipette tips. From the edges of each plate, side walls project further downwards than the pipette tips inserted therein. In a stacked arrangement, the lowermost rack is inserted into a box, wherein the side walls engage in a recess in the box and support themselves on the bottom of the box via a base plate. Five racks are stacked one above the other, wherein the lower edges of the side walls of an upper rack support themselves on the upper edge of the side walls of a lower rack. Inserted pipette tips thereby engage with each other in racks stacked one above the other. A hood-like cover element covers the uppermost rack. A plurality of pipette tips is hereby combined in a space-saving manner. For removing pipette tips by means of a pipette, individual racks can be removed from the stack and made available in the box. This carrier is suitable for nestable pipette tips. The stacking of several racks one above the other is difficult, because small displacements of pipette tips can lead to them not engaging correctly with each other. The apron permanently connected with the plate provides a rigid stack pattern and covers the view of the contents. Moreover, the apron largely prevents a sufficient sterilization.

Non-nestable pipette tips are combined in boxes stacked one above the other as described in U.S. Pat. No. 6,221,317 B1.

In the case of the sales unit with refill packages for non-nestable pipette tips Tip One® from the company USA Scientific, two plates with 96 pipette tips each are each inserted into deep-drawn double shells. Each double shell is closed by a cover. Five double shells are stacked one above the other to form one unit with a total of 960 pipette tips. This arrangement also takes up a lot of space and requires a lot of material.

Starting from this, the present invention is based on the objective to provide a carrier for pipette tips which is particularly suited for the utilisation in automatic machines. That is to say, the carrier is distinguished by its particular stability and its suitability for being handled by automatic elements (like gripping arms, metering head e.g.). Thus, an essential aspect of the objective is to provide a carrier whose plate and frame cannot be separated without intent, by errors of the automatic machine e.g., but whose elements (plate and frame) can be detached simply when this is intended.

This objective is achieved by a carrier with the features of embodiment 1. Advantageous embodiments of the carrier are indicated in the subclaims.

Furthermore, the object of the invention is to create a device for the space- and material-saving stacking of non-nestable pipette tips, only partially insertable into each other, in several plates one above the other.

The carrier for pipette tips of the present invention has:

a frame, featuring four side walls, a plate with a plurality of holes for inserting pipette tips, and means for detachably connecting the frame and the plate, that have contact surfaces on the upper edge of the frame and on the underside of the plate, which touch each other when the plate is put onto the frame, and that have guiding elements directed transversally to the contact surfaces on the frame and on the plate, which engage into each other with lateral clearance when the plate is put onto the frame.

In the carrier of the present invention, the means for detachably connecting the frame and the plate have contact surfaces touching each other on the upper edge of the frame and on the lower side of the plate. Further, they comprise guiding elements of carrier and plate that engage into each other transversally to the contact surfaces with lateral clearance. The guiding elements are preferably aligned vertically to the contact surfaces. Yet, they may also be aligned inclinedly to the contact surfaces. Due to the arrangement of the contact surfaces, the plate is covered laterally not at all or only in parts by the frame. As a consequence, a gripping tool of an automatic machine can have access to the edges of the plate, in order to put a plate onto the frame or to take it away from the frame. Thus, the edges of the plate are adapted for the transportation by a gripping tool. The plate is relatively stiff in the direction of this load by a gripping tool, so that it resists the clamping force of the gripping tool and can be safely held by the same. By the engaging guiding elements of the means for detachably connecting, the plate is safely held on the frame. The guiding elements of frame and plate engage into each other with lateral clearance. The joining of plate and frame is facilitated by this clearance between the engaging guiding elements, so that it may be performed more easily automatically. This holds also for lifting the plate from the frame when an empty plate is to be replaced by a filled plate. The parts of plate and frame engaging with clearance match can compensate for inaccuracies of an automatically operated gripping device. A plate pre-filled with pipette tips can be put onto the frame, so that the carrier can be filled with pipette tips automatically. The plate may feature e.g. 24, 48, 96, 384 or 1536 holes for inserting pipette tips. In case that a hooked-up pipette tip occurs in an erroneous withdrawal by a metering tool, and the plate is lifted along with the pipette tip through this and is in danger to fall out, there will be a toe-in between the guiding elements that engage with lateral clearance resulting in a release of the hooked-up pipette tip from the plate, so that the plate slips back into the frame into its original position. Thus, this intended toe-in prevents unintended separation of the plate from the frame and increases the safety of the automatic processes. In particular, the continuation of the automatic pipetting process is made sure in this way, without that any manual intervention is necessary.

The present invention incorporates embodiments wherein the frame and the plate are each one provided with only two guiding elements, which can be brought into engagement with each other. Preferably, the frame and the plate have plural guiding elements each, four in particular, a guiding element of the plate being associated to each guiding element of the frame and the associated guiding elements being adapted to be brought into engagement with each other. The associated guiding elements of frame and plate are arranged on different positions of frame and plate. They are preferably arranged at opposing side walls of the frame and at opposing edges of the plate. Further preferably, they are arranged at diametrically opposing positions of the side walls and of the edges of the plate.

The guiding elements that are adapted to be brought into engagement with lateral clearance can be realised in different ways. For instance, it is dealt with an upper opening of the frame and a collar at the lower side of the plate that is adapted to be inserted into the upper opening with clearance. According to a preferred embodiment, the guiding elements feature columns and bores suitable for insertion of the columns with lateral clearance, and/or ribs and grooves that are suitable for insertion of the ribs with lateral clearance. Due to the clearance match, the inner diameter of the bores or the width of the grooves, respectively, exceeds the outer diameter of the columns or the wall width of the ribs, respectively. According to a further embodiment, the columns and/or the ribs project from the upper edge of the frame and the plate features the bores and/or grooves at the underside. However, the invention incorporates also embodiments in which the columns and/or the ribs project from the underside of the plate and the upper edge of the frame features the bores and/or grooves. Finally, embodiments are incorporated in which the upper edge of the frame features columns and/or ribs and bores and/or grooves, and the underside of the plate features corresponding bores and/or grooves and columns and/or ribs. The bores may be through bores or blind bores, and the grooves may have a groove bottom or may be realised as through slits.

The columns may have different shapes. For instance, they may be cylindrical and have a circular or polygonal cross section. The same holds for the bores in a corresponding way.

The ribs may have a constant wall thickness. Further, they may have a straight, angled or curved course. Corresponding holds for the grooves.

According to a preferred embodiment, the columns taper at least in sections in the direction towards their free end, and/or the bores widen up at least in sections in the direction towards their insertion openings for the columns. The columns may also taper over their entire height and/or the bores may widen up over their entire depth. Further, the ribs can taper at least in sections in the direction towards their free end, and the grooves may widen up at least in sections in the direction towards their insertion openings for the ribs. But however, the ribs may taper over their entire height and/or the grooves may widen up over their entire depth. The tapering columns or ribs and the widening bores or grooves facilitate the joining of the plate with the frame, and thus they favour the handling by automatic machines. According to a further embodiment, the columns and the bores are arranged on the corners of the frame and the plate. Further, the invention incorporates embodiments wherein the columns and the bores are arranged between the corners of the frame and the plate.

According to a further embodiment, the frame features a waistline. The waistline favours a positive fit and safe grasping of the entire carrier by way of a gripping device of an automatic machine. Thus, the waistline is favourable for a safe and accurate positioning of the entire carrier. Due to the waistline, the carrier may be grasped safely with less gripping force. In principle it is sufficient that the waistline be formed by two opposing side walls of the frame. Preferably it is formed between all the opposing side walls, so that the carrier can be grasped safely from out two directions.

For instance, the waistline may be formed by deepenings in the outer side of opposing side walls. According to one embodiment, the waistline is limited at its upside by an outwardly protruding upper projection of the frame. This limitation can prevent the carrier from falling out of a gripping device. Further, the waistline can be limited at the downside by an outwardly protruding lower projection of the frame. By the shaping of the waistline, the bending force when it is grasped by way of a gripping device can be optimised, so that the frame resists the loads through the gripping device.

The present invention incorporates embodiments wherein the frame is open at the downside. This frame is adapted to be put onto a support with a lower edge. According to one embodiment, the frame is closed at the downside by a bottom. The bottom protects pipette tips against contaminations from out the downside. The lower projection may be formed by an edge of the bottom that projects towards the outside over the side walls.

According to a further embodiment, the dimensions of the ground area of the frame coincide with the dimensions of the ground area of microtiter plates according to the standard of the Society for Biomolecular Screening (SBS). This standard has been published by the American National Standards Institute (ANSI) with the designation ANSI/SBS 1-2004 and is designated as the "SBS Standard" in the following. According to this, a microtiter plate has a ground area ("Footprint") with a length of 127.76 mm and a width of 85.48 mm. The ground area of the frame has the same dimensions. Conventional automatic machines feature bearing positions for microtiter plates that have the mentioned dimensions. These bearing positions are provided with guiding- and clamping devices which are matched to the mentioned dimensions. These bearing positions and guiding- and clamping devices can be used for positioning the carrier that has a ground area according to SBS Standard. A waistline permits to conform with the standard even in case that the frame has a lateral projection at the upside for supporting it on a gripping tool.

According to a preferred embodiment, the frame has a free cross section between the side walls. In this embodiment, the side walls are not connected between each other by inner walls, like in the carrier according to U.S. Pat. No. 6,221,317 B1. As a consequence, putting up a plate with inserted pipette tips cannot be disturbed in that the pipette tips collide with inner walls in the frame. According to a further embodiment, the side walls are provide with vertically running ribs on their inner side, which stiffen the side walls. The vertically running ribs can be dimensioned such that they grasp only slightly into the inner space of the frame and a great free cross section for accommodating pipette tips remains between the side walls.

According to one embodiment, the plate features a gripping edge projecting beyond the upper side of the plate on each one of at least two opposite edges. The gripping edges can be used as additional contact surfaces by the gripping tool of an automatic machine. Further, the gripping edges can serve as protection- and gripping edges for preventing the contamination of the pipette tips in the manual assembly of a carrier with the plate. Preferably, the gripping edges project from the upper side of the plate at least as high as the pipette tips that are inserted into the plate. The gripping edges may be arranged on the two longitudinal edges of the plate. In addition or instead of this, they may also be arranged on the two front side edges of the plate.

According to a further embodiment, the carrier has a cover cap with a cover cap bottom and cover cap side walls projecting towards the downside from the edge of the cover cap bottom which can be put onto the frame. The cover cap covers pipette tips at the topside that are held in the frame by way of a plate. In order to position the cover cap on the carrier, the frame has a circumferential shoulder on the outside onto which the cover cap can be put with the lower edge of the cover cap side walls. The accurate positioning favours the sealing of the cover cap with respect to the frame. The circumferential shoulder on the outside can be formed on an outwardly projecting upper projection which limits a waistline.

According to a further embodiment, the cover cap has an edge surface limiting the shoulder at the outside, which is aligned with a further edge surface that limits at least the lower edge of the cover cap side walls at the outside when the cover cap is put up. The edge surfaces aligned with each other can be used for attaching a sealing adhesive tape. Sterile custody of pipette tips in the carrier can be made sure by the adhesive tape.

According to a further embodiment, the dimensions of the ground area of the frame exceed the outer dimensions of the frame in the region of the upper edge surface. By this, it can be made sure that the dimensions of the carrier do not exceed the SBS-format even when an adhesive tape for sealing a cover cap is attached. The difference of the dimensions is preferably 0.05 to 1 mm. More preferably it is 0.1 to 0.5 mm.

According to a further embodiment, the bottom is a hollow bottom having a downwardly projecting enclosure, the bottom being adapted to be put onto the upper edge of the cover cap. The enclosure can laterally grasp over the cover cap side walls or guiding bridges that project upward from the cover cap. This permits safe stacking of several carriers one above the other.

According to a further embodiment, the cover cap features deepenings in the outer sides of two opposing cover cap side walls. The deepenings permit a positively fitting contact to a gripping tool of an automatic machine, and so they favour the automatic lifting of the cover cap. Further, when the cover cap is made transparent, the deepenings favour the read-out of a tag on the upper edge of the carrier, which can be realised as a bar code for instance.

Furthermore, the object is achieved by a device with the features of embodiment 22. Advantageous embodiments of the device are specified in the embodiments described herein.

The distance piece according to the invention for holding an upper plate with a plurality of holes for inserting pipette tips spaced from a lower plate with a plurality of holes for holding pipette tips is frame-shaped, has an intermediate bottom with a plurality of additional holes for the lateral guiding of pipette tips, can be placed onto the bottom side of the upper plate with its top side outside of the holes and can be placed with its bottom side onto the top side of the lower plate or of pipette tips held in the lower plate.

The distance piece bridges the distance between an upper and a lower plate, which is required in order to partially insert into each other pipette tips that are inserted into the upper and the lower plate, non-nestable and partially insertable into each other. The distance piece can hereby ensure that the pipette tips are only loosely inserted into each other and do not clamp together or respectively support themselves on the filters so that the upper plate can be easily removed from the distance piece without taking along pipette tips from the lower plate or respectively damaging filters.

The distance piece can be used to hold plates, which can also be used to hold conical pipette tips. As a result, uniform plates can be used for nestable and for non-nestable pipette tips. Moreover, the frame-shaped distance piece protects the pipette tips from contamination. The intermediate bottom with the additional holes for laterally guiding pipette tips holds the pipette tips in vertical alignment. Thus, the arrangement of the plate and distance piece with inserted pipette tips is easily stackable and transferrable into a box for receiving pipette tips. Since the installation height of the distance piece is dimensioned such that the pipette tips can be partially inserted into each other without clamping in each other or respectively loading a filter, material is saved in comparison with boxes stacked on top of each other and with racks stacked on top of each other with deeply down-turned side walls. When removing pipette tips, the distance piece does not have to support the plate so that its distance piece side walls can be designed in a particularly thin and material-saving manner.

The plates stacked on top of each other with the help of the distance pieces are housable in a correspondingly small outer packaging. Further material is hereby saved. The non-nestable pipette tips are housed in one stack in the smallest space.

According to one embodiment, the distance piece has distance piece side walls opening towards the top so that several same distance pieces are stackable within each other. The stackability is advantageous for the space-saving storage before use of the distance piece and for reducing the volume of waste after discharging the pipette tips from the upper plate.

According to a further embodiment, the distance piece has locking elements on the upper edge, which are lockable with locking elements on the bottom side of the upper plate. Through the locking, the upper plate is combined with the distance piece to form one unit, which can be easily removed from the stack and can be transferred into a box for the discharging of the pipette tips. The distance piece hereby aligns the pipette tips and protects them from contamination. The locking of the distance piece with the upper plate is preferably releasable so that after discharging the pipette tips the distance piece can be released from the plate. It can subsequently be stacked with further distance pieces in a space-saving manner. Furthermore, this is advantageous for separate disposal of the distance pieces and plate if they are made of different materials.

According to a further embodiment, the distance piece has locking tabs protruding outwards on the upper edge from at least two opposite distance piece side walls with insertion chamfers for locking behind locking edges on an apron-like downwardly protruding edge area of the upper plate. A simple and secure locking of distance piece and plate is hereby promoted and can also be established by an automatic machine during production.

According to a further embodiment, stiffening ribs are present between the locking tabs and distance piece side walls. The stiffening ribs protect the locking tabs from damage.

According to a further embodiment, the intermediate bottom has ribs on the top side between the holes, which extend from a distance piece side wall to the opposite distance piece side wall. The ribs reinforce the distance piece so that it can be produced with a reduced amount of material. Moreover, they facilitate the insertion of pipette tips during production.

According to a further embodiment, the intermediate bottom bears intersecting ribs. Even stronger rigidity and improved material savings are hereby achieved.

According to a further embodiment, the distance piece has guiding elements protruding downwards and/or upwards from the intermediate bottom for lateral guiding on pipette tips, which are held by a lower and/or by an upper plate. The guiding elements stabilize a stack of several plates and at least one distance piece in that they laterally guide the distance piece on the pipette tips.

According to a further embodiment, the guiding elements comprise lower and/or upper sections of distance piece side walls, which protrude downwards and/or upwards from the intermediate bottom in order to support themselves on the top side and/or the bottom side of a lower and/or upper plate and to be guided on the periphery of pipette tips, which are inserted near the edge into the lower and/or upper plate. The invention includes embodiments, in which sections of distance piece side walls protrude from the intermediate bottom exclusively upwards or exclusively downwards. Furthermore, it includes embodiments, in which sections of distance piece side walls protrude from the intermediate bottom both upwards as well as downwards. The protruding sections of distance piece side walls are laterally supported on the pipette tips, which are inserted near the edge into the plate, on which these sections of the distance piece side walls are supported.

According to a further embodiment, the intermediate bottom bears protruding guiding elements on the bottom side between the additional holes. The intermediate bottom is supported with the edge of its additional holes on the heads of the pipette tips, which are inserted into the lower plate. The diameter of the additional holes should be dimensioned such that the pipette tips held in the upper plate can freely immerse and the round areas of the additional holes can be supported on the heads of the pipette tips held in the lower plate. The guiding elements protruding between the additional holes support the distance piece laterally on the heads of the pipette tips, which are arranged near the edge or at a further distance from the edge. These guiding elements are designed according to one embodiment as strip-like projections. Other geometries of these guiding elements are possible. For example, each guiding element can extend annularly around a hole in order to laterally support itself on the upper periphery of a pipette tip head. Guiding elements protruding between the holes make it possible to do without guiding elements protruding downward in an apron-like manner. In this embodiment, the intermediate bottom is connected with the lower edge of the side walls. Further material can hereby be saved. Furthermore, this design promotes the view of the pipette tips from the side in the stack and sterilization of the tips.

The distance piece is preferably made of plastic. It is preferably injection-molded. It is preferably made of one piece. It is preferably made of polypropylene (PP).

Furthermore, the invention comprises a carrier for pipette tips with a frame or box having four side walls, several plates with a plurality of holes for inserting pipette tips, pipette tips inserted into the holes of the plates, means for releasably connecting the frame or the box with a plate, a lower plate, which is connected via the means for releasably connecting with the frame or the box, a distance piece placed with the bottom side on the lower plate or on the pipette tips in the plate according to one of embodiments 22 to 33 and an upper plate, which is supported with the bottom side on the top side of the distance piece.

The frame or box and the plate can be designed like the carrier for pipette tips according to one of embodiments 1 to 20 described herein. Furthermore, the frame or box and plate can also be designed without the guiding elements of the carrier of embodiments 1 to 20 described herein. The carrier enables a space- and material-saving housing of at least two plates equipped with pipette tips. After transfer of the upper plate into a box, the pipette tips inserted into it can be discharged by means of a pipette.

According to a preferred embodiment, several arrangements of distance piece and plate are stacked on top of each other.

According to a further embodiment, the upper plates have, on an apron-like, downwardly protruding edge area, inwardly protruding locking tabs and the locking elements of the distance piece are locked with the locking tabs of the upper plate. The locking is easily established by bending the apron-like, downwardly protruding edge of the upper plates outward and is releasable by expanding this edge. The apron-like, downwardly protruding edge also stabilizes the plate.

According to a further embodiment, a hood-like cover covering the pipette tips on the top and on the side is placed on the top on the uppermost plate. The pipette tips in the uppermost plate are hereby also protected from contamination.

According to a further embodiment, the plates have an outwardly protruding, circumferential step and the cover is placed on the top side of the step of the uppermost plate. The cover is hereby advantageously guided on the uppermost plate.

According to a further embodiment, the diameter of the additional holes of the intermediate bottom is the same size or smaller than the diameter of the holes of the plate and smaller than the outer diameter of the heads of the pipette tips.

According to a further embodiment, the carrier comprises several same plates and/or several same distance pieces. The carrier can thus be assembled from uniform components.

The plates are preferably made of plastic. They are preferably injection-molded. They are preferably made of one piece. They are preferably made of polypropylene (PP).

According to a further embodiment, the carrier is surrounded by a strap and/or shrink-wrapped with a film. A stable sales unit protected from contamination is hereby provided. The outer packaging is alternatively a folding box. The band and/or the film and/or the folding box are preferably made of plastic, preferably of polypropylene or another plastic, which permits autoclaving.

Finally, the invention relates to an arrangement made up of several carriers according to one of the embodiments 34 to 39, each of which are surrounded with an edge and shrink-wrapped altogether with a film. A stable sales unit protected from contamination with a particularly large number of pipette tips is hereby provided.

According to a further embodiment, the carrier comprises a frame-shaped distance piece, which is adapted to be put onto the upper side of a plate with its lower edge outside of the holes, and with its upper edge onto the lower side of a plate outside of the holes. The distance piece permits to stack several plates filled with pipette tips onto one single frame. In this, the lowermost plate filled with pipette tips is arranged directly on the frame. A distance piece is arranged on this lowermost plate, and on the distance piece in turn a plate filled with pipette tips. If need be, further distance pieces and plates are alternately disposed on this. The distance piece prevents that pipette tips arranged in different plates are pressed into each other, and that the pipette tips of a plate disposed below are lifted along when a plate is lifted.

According to one embodiment, the distance piece has an intermediate bottom with further holes. When a plate with inserted pipette tips is put onto the distance piece, the pipette tips are guided by the further holes, so that they are safely guided into the upper openings of pipette tips that are inserted into a plate that is disposed below. Preferably, these further holes are dimensioned such that they prevent pipette tips of a plate disposed below from being lifted along when a plate with inserted pipette tips is lifted. The pipette tips of the deeper disposed plate are held on the holes and fall back into the deeper disposed plate. The stack is positioned by the partly intermeshed pipette tips in plates that are disposed one above the other. A cover cap may be slackly positioned on the uppermost plate.

BRIEF DESCRIPTION OF THE DRAWINGS

The present invention is explained in the following, by means of the attached drawings of an example of its realisation. In the drawings show.

DETAILED DESCRIPTION OF THE INVENTION

In the present application, the designations "up" and "down", as well as "vertical" and "horizontal" are related to an arrangement of the carrier in which the same is put onto a ground with a downside edge or a bottom of the frame, and pipette tips inserted into a plate that is put onto the frame are kept in a distance from the ground.

Figure 1:
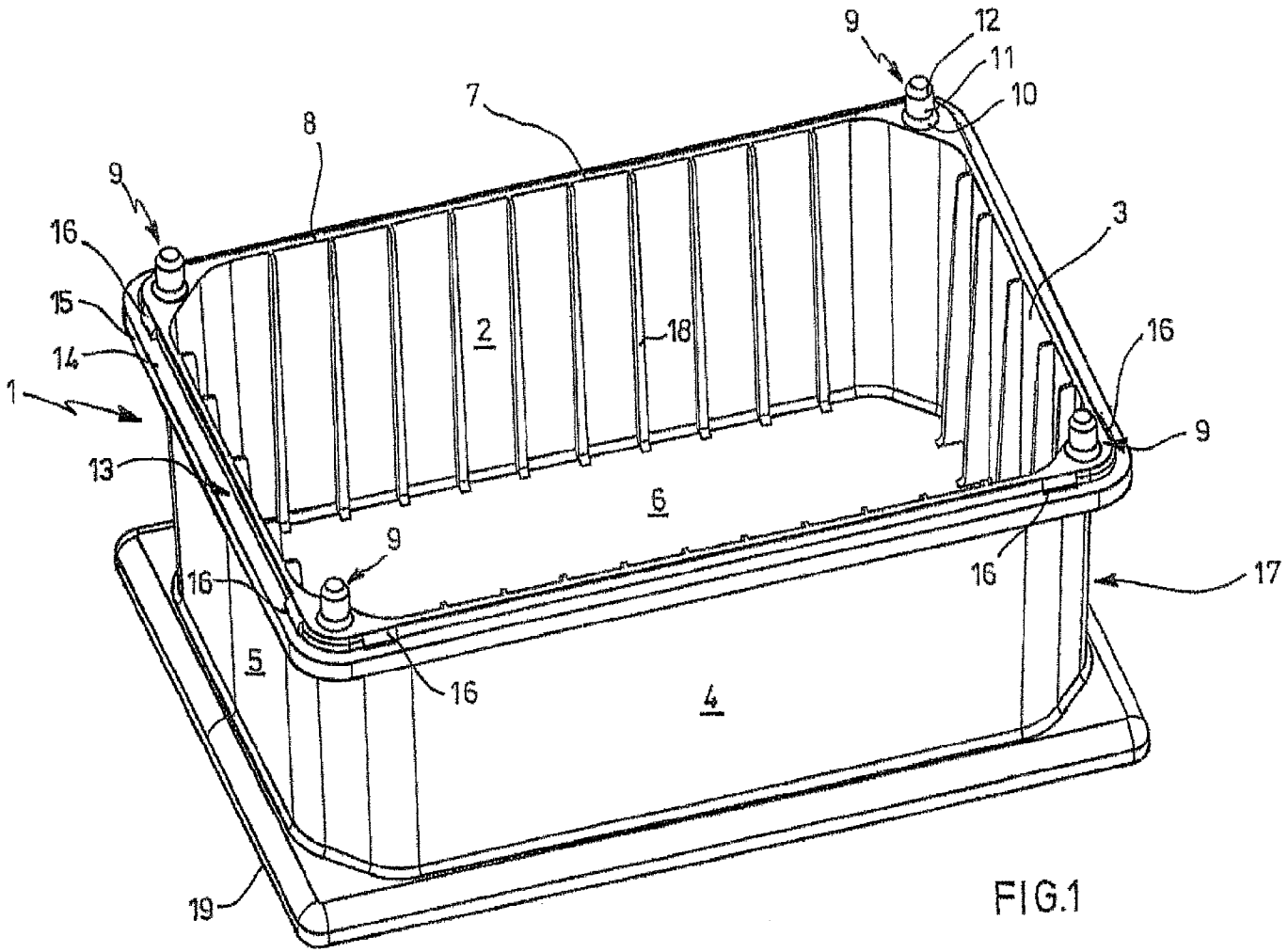
FIG. 1 a frame of the carrier provided with a bottom, in a perspective view at slant angle from the upside and from the side.

According to FIG. 1, a frame 1 has four side walls 2, 3, 4, 5. From these, two opposing side walls 2, 4 are longer than two other opposing side walls 3, 5. The side walls 2 to 5 stand up from a bottom 6. The bottom 6 has an approximately rectangular shape. At the outside, it projects somewhat over the side walls 2 to 5. Its length and width correspond to the dimensions of the ground area according to the SBS standard.

On its upper edge 7, the frame 1 has a flat contact surface 8, which circulates along the side walls 2 to 5, parallel to the bottom 6 or horizontally, respectively. The contact surface 8 is somewhat widened at the corners between the side walls 2 to 5. In each corner, a column 9 projects vertically from the contact surface 8, which has conical base section 10, a cylindrical centre section 11 and a conical end section 12.

At the outside, a step 14 circulates on the upper edge 7 on the topside of an upper projection 13, which is also formed flat and parallel to the bottom 6. The upper projection 13 is arranged somewhat below the contact surface 8. At the outside, the step 14 is limited by a circumferential, vertically aligned edge surface 15 of the upper projection 13. Between the upper projection 13 and the contact surface 8, positioning noses 16 project from the frame 1 towards the outside.

The upper projection 13 and the bottom 6 projecting at the downside limit a circumferential waistline 17 of the frame 1. On the inner sides, the side walls 2 to 5 feature ribs 18. These extend from the bottom 6 up to the upper edge 7.

The bottom 6 is a hollow bottom with a circumferential downwardly projecting enclosure 19, whose underside is flat and forms a standing surface. Further, ribs 20 running in parallel to its transversal side edges project from the underside of the bottom 6 (compare FIG. 6).

The frame 1 can be made from plural parts. Preferably it is made in one single piece. Further preferably, it is made of plastic material. It is preferably injection moulded. In order to create the waistline 17, the frame 1 has to be injection moulded by means of a slider tool.

As materials, polypropylene (PP), polycarbonate (PC), acrylonitrile-butadiene-styrene-copolymer (ABS), polystyrene (PS) or a metal (aluminium for instance, if need be anodized) are contemplated in particular. Polypropylene is particularly cost-saving. Polycarbonate and metal have the advantage to be treatable in an autoclave, and thus to be re-usable. The frame is preferably made of polypropylene. Unfilled or filled (with glass fibres for instance) polypropylene may be used. Filled polypropylene has a higher tenacity than unfilled polypropylene.

Figure 2:
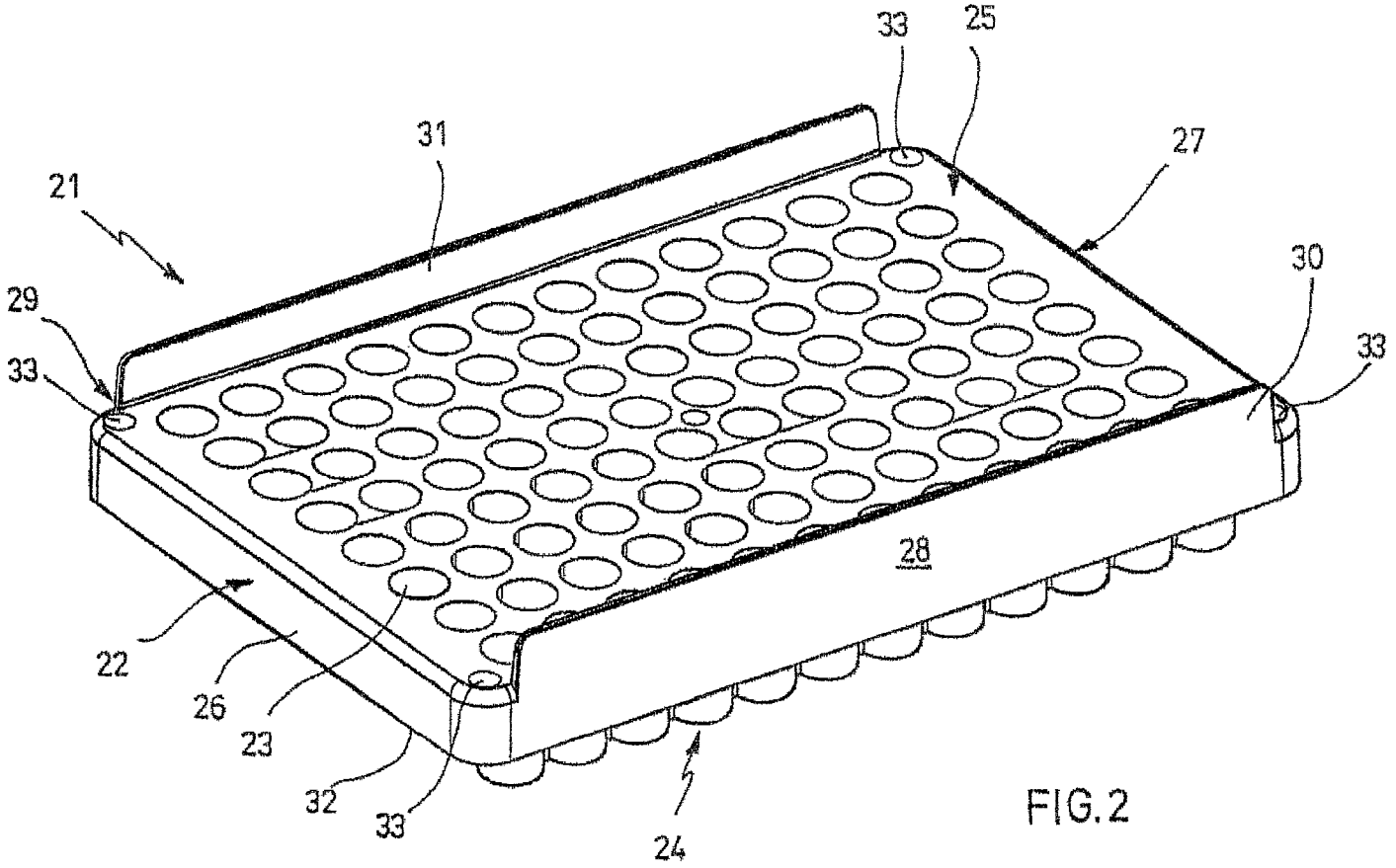
FIG. 2 a plate of the carrier, in a perspective view at slant angle from the upside and from the side.
Figure 3:
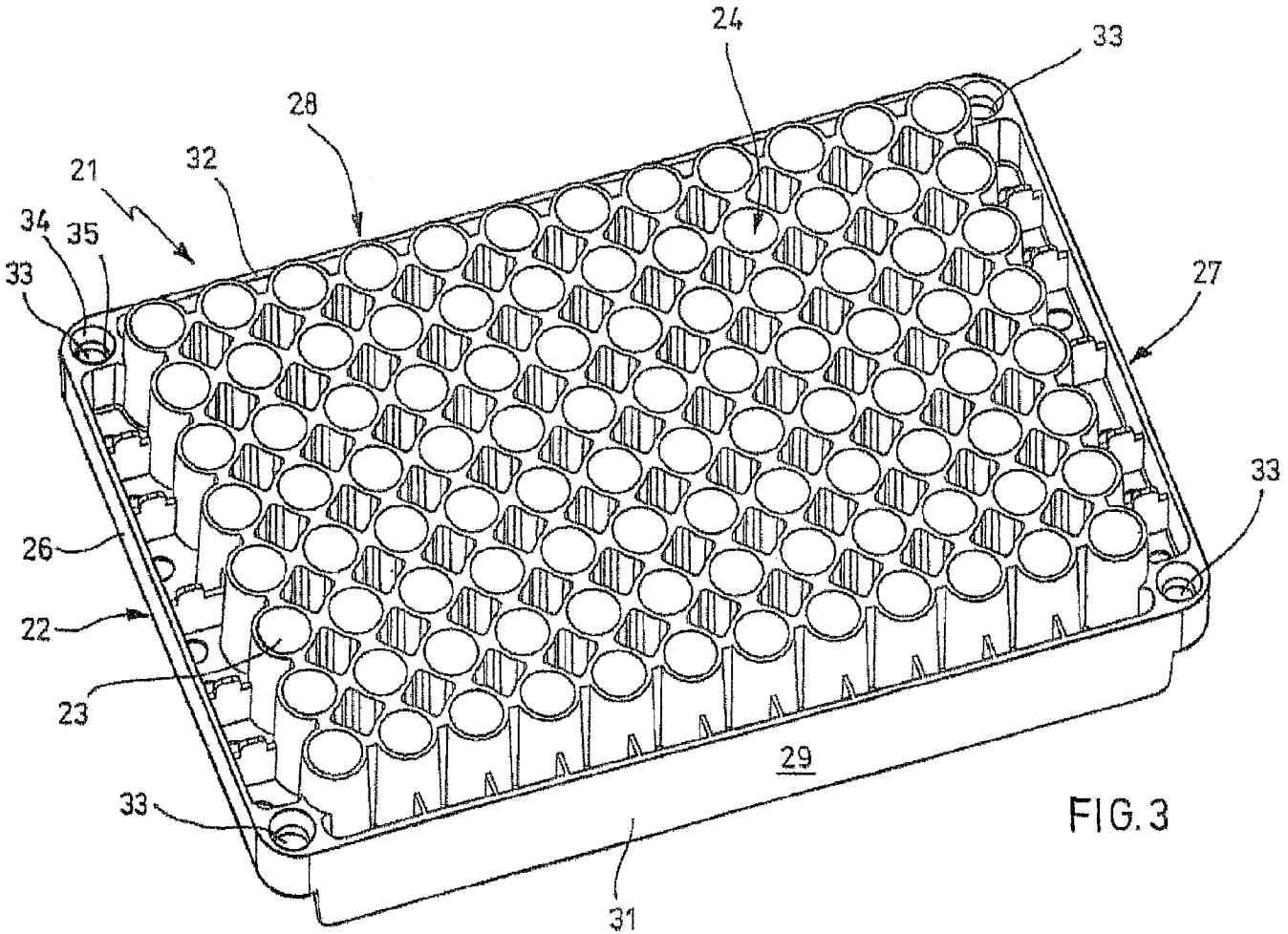
FIG. 3 the same plate, in a perspective view at slant angle from the downside and from the side.

According to FIGS. 2 and 3, a plate 21 has a substantially board-shaped base body 22 with a plurality of holes 23, which extend from the underside 24 to the upside 25 of the base body 22.

The holes 23 are arranged regularly in rows and columns of a matrix. In the example there are 96.

The plate 21 has two short edges 26, 27 and two long edges 28, 29. At each of the long edges 28, 29 it has one board-shaped gripping edge 30, 31 that projects over the upper side 25.

On the downside 24, the board shaped base body 22 has a further flat contact surface 32 that circulates on the edge. The further contact surface 32 is arranged somewhat above the lower openings of the holes 23. In the corners of the board-shaped base body 22, it has widenings in which through bores 33 are arranged.

Each bore 33 has a conical section 34 at the downside, and adjoining to this a cylindrical section 35. The dimensions of the bores 33 are selected such that the columns 9 are insertable with a clearance. The conical sections 34 form insertion slopes which facilitate the insertion of the columns 9 into the bores 33. Moreover, the conical end sections 12 of the columns 9 facilitate the insertion into the bores 33.

In the example, the plate-shaped base body 22 is realised as a quiver plate. In the same, the holes 23 are formed in quiver- or sleeve shaped structures, which are laterally connected by bridges and on the upper edge by a plate, and are enclosed by a circumferential edge. Instead, the plate 21 may also be formed as a bridge plate, wherein a thin plate with a plurality of holes 23 features bridges that enclose the holes at its downside. Realisations as a quiver- or bridge plate are materials saving and stable and laterally support the pipette tips that are inserted into the holes. Instead, the plate can also be realised massively, i.e. without cavities outside of the holes 23 and bores 33.

The plate 21 is preferably made in one single piece. Further preferably it is made of plastic material. It is preferably injection moulded. The plastic materials polypropylene (PP), polycarbonate (PC), acrylonitrile-butadiene-styrene-copolymer (ABS) and polystyrene (PS) can be used in particular. The frame 1 and the plate 21 can be made of the same or of different materials. For instance, the frame 1 can be made in a cost-saving way of polypropylene, and the plate 21 of polycarbonate, so that the plate is particularly stable. A further example is a frame 1 of polycarbonate adapted for autoclave treatment, and a cost-saving plate 21 of polypropylene, wherein a sufficient stability can be made sure by the structure of the plate 21. Polypropylene is preferably used for the plate 21.

Figure 4:
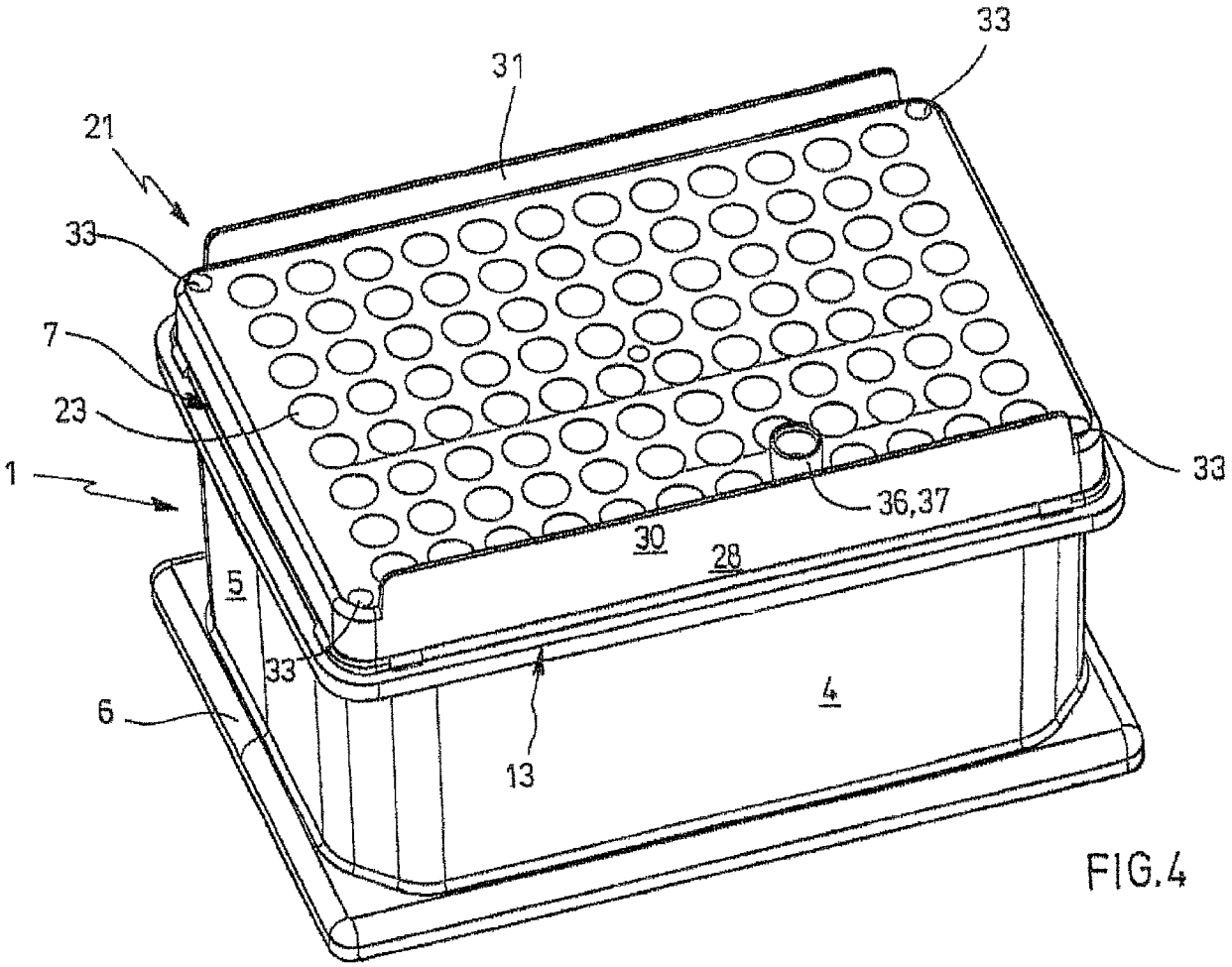
FIG. 4 the plate when put onto the frame, in a perspective view at slant angle from the upside and from the side.
Figure 11:
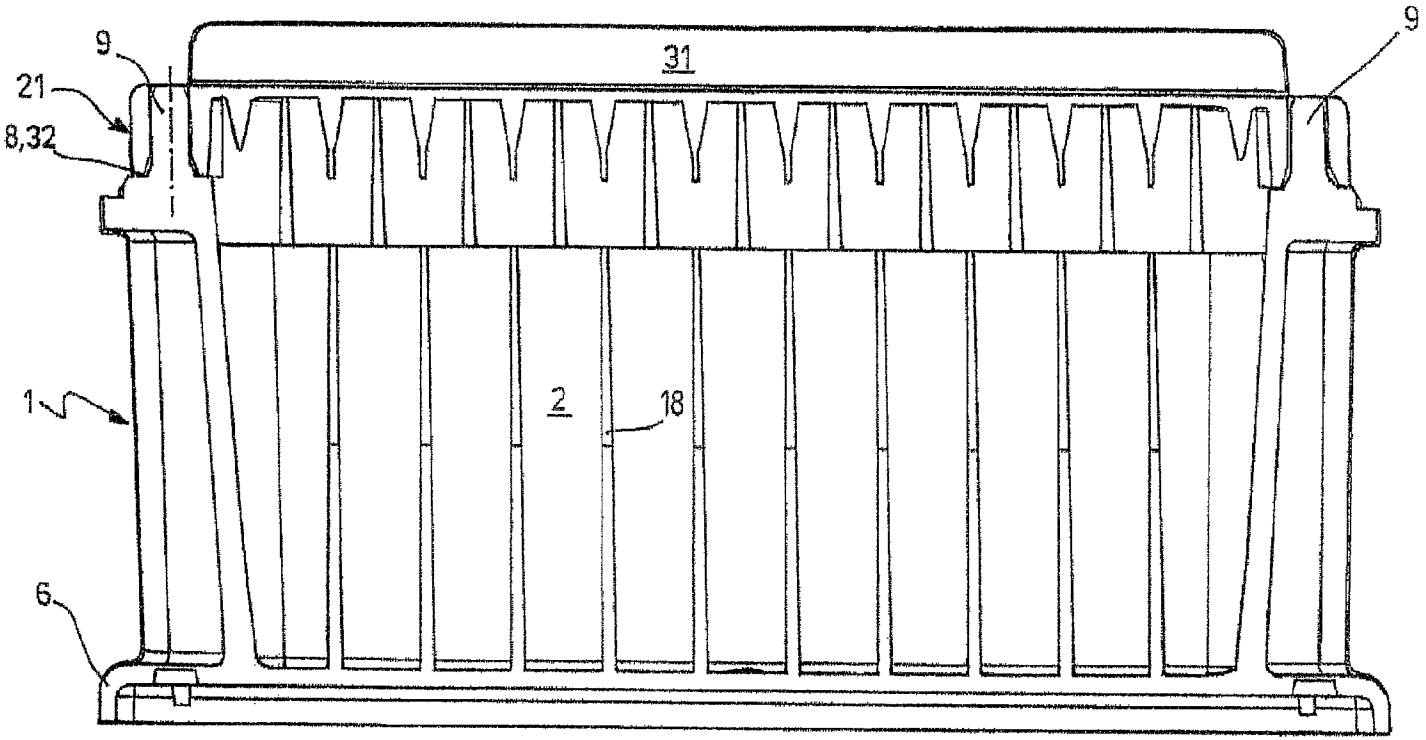
FIG. 11 the same arrangement as FIGS. 5 and 6 in a vertical section.

According to FIGS. 4 and 11, the plate 21 is put onto the upper edge 7 of the frame 1. The further contact surface 32 (see FIG. 2) rests on the contact surface 8 (see FIG. 1), and the columns 9 grasp into the bores 33. For the sake of illustration, in FIG. 4 a pipette tip 36 is set into a hole 23 of the plate 21 from out the upside. The pipette tip 36 has a widening 37 at its upper side, which prevents it from falling through the hole 23.

When the lugs of a metering tool are pressed into the upper openings of eight pipette tips, the plate 21 is loaded with a force of about 100 to 400 Newton, preferably 200 to 300 Newton, about 240 Newton in particular. Even when made of polypropylene, the plate 21 resists these loads due to its structure and its support via circumferential contact surfaces 32 without disadvantageous bending. The frame 1, even when made of polypropylene, is also not overburdened in this.

Figure 12:
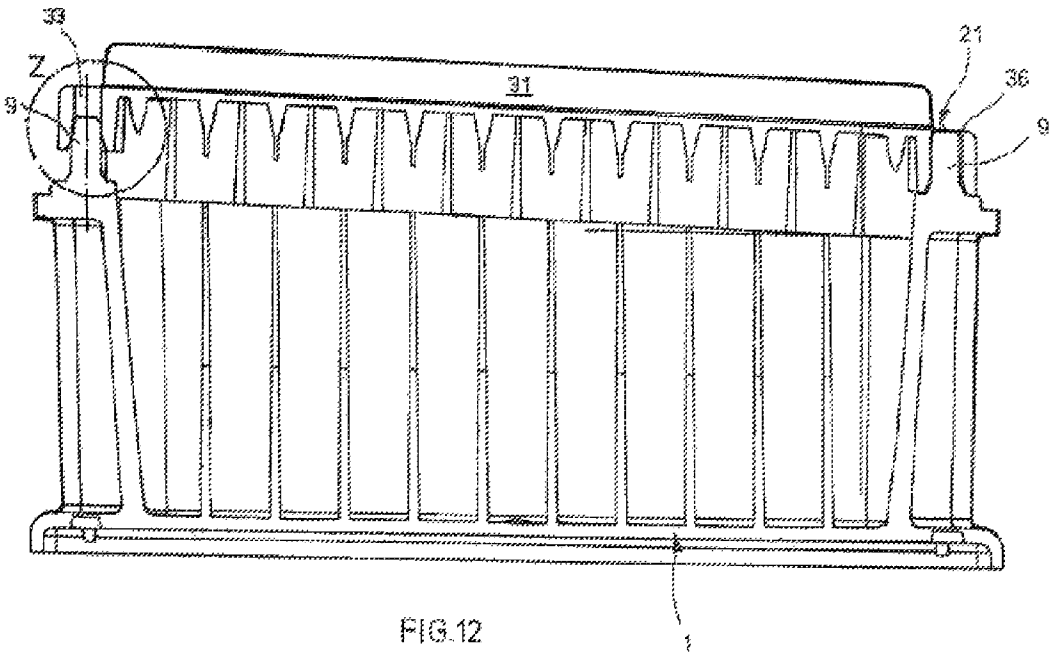
FIG. 12 the same arrangement with swung and wedged cover cap in a vertical section.
Figure 13:
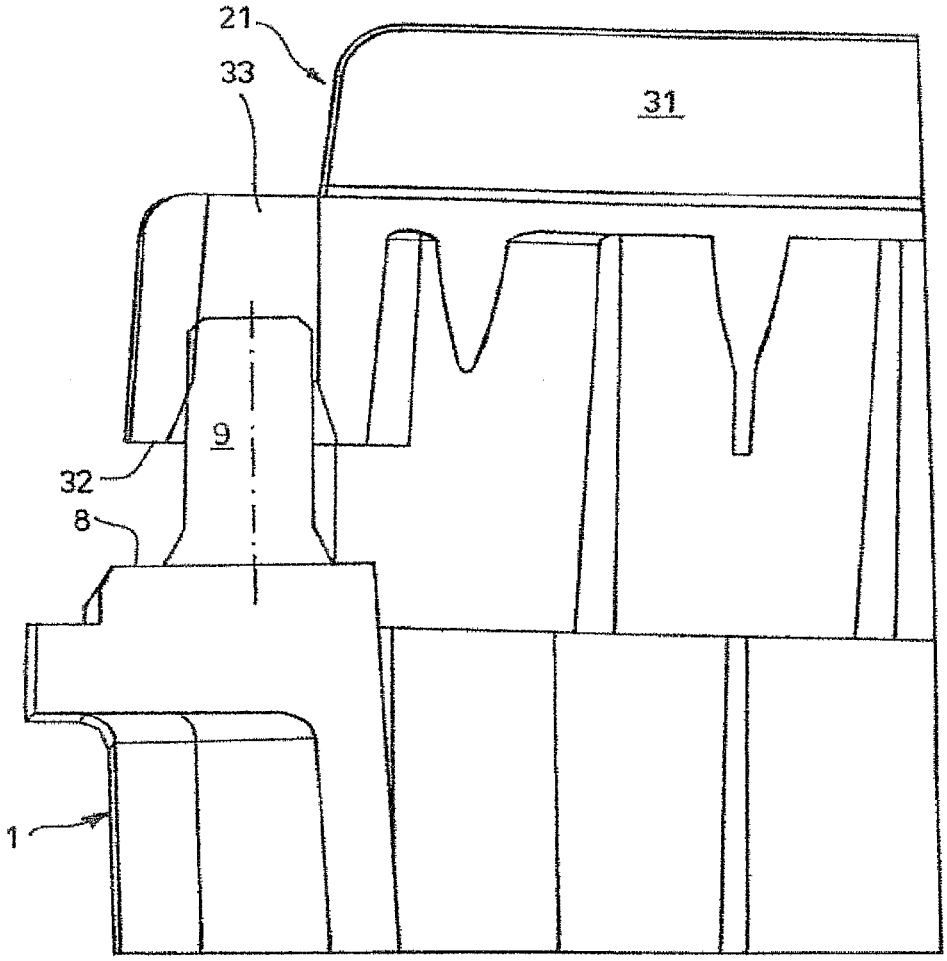
FIG. 13 an enlarged detail of FIG. 12.
Figure 14:
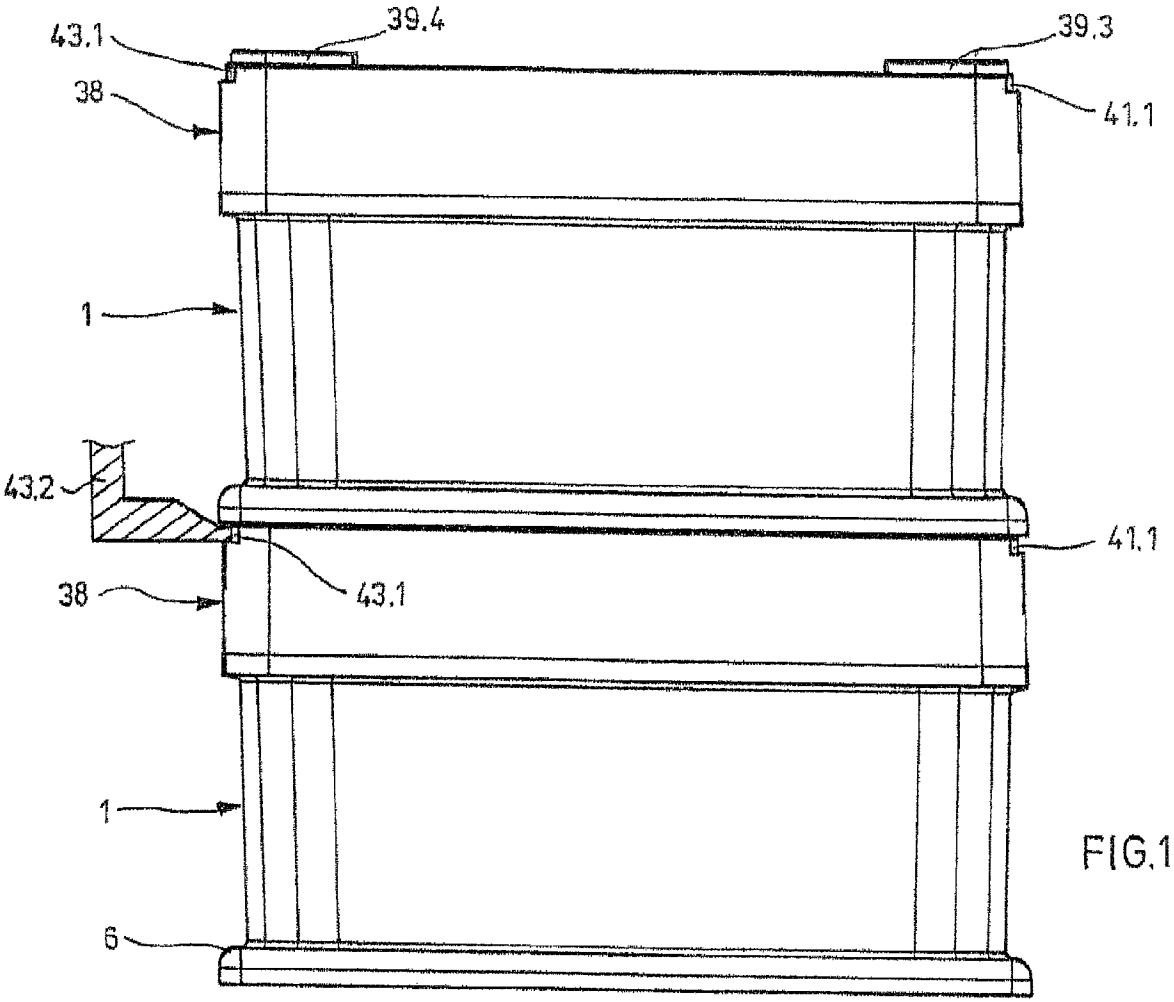
FIG. 14 arrangements according to FIGS. 5 and 6, stacked one above the other in a side view.

When the plate 21 is lifted through pipette tips 36 that hook itself up in the removal of pipette tips 36, the plate 21 gets tilt or is inclined, respectively. This is due to the asymmetrical weight distribution of the plate 21 with respect to the hooked-up pipette tips 36. As a consequence, the columns 9 wedge themselves in the bores 33 (compare FIGS. 12 and 13). Through this, the plate 21 is stripped off by the lifted pipette tips 36 and falls back into the starting position.

The shape of the columns 9 and the bores 33 as well as the clearance between them facilitate to put the plate 21 onto the frame 1. However, the plate 21 is safely held on the frame 1. A safe transportation can be performed by a gripping tool of an automatic machine. The gripping tool may enclose the frame 1 on the outer sides of opposing side walls 2, 4 or 3, 5 on the waistline 17. The outwardly projecting projection 13 and the bottom 6 prevents the gripping tool from slipping through.

The edges 26 to 29 of the plate 21 can be accessed from the outside and may be easily grasped by a gripping tool. The gripping tool catches preferably on the longer edges 28, 29, which are provided with the upside-projecting gripping edge 30, 31. A gripping edge may have other elements in addition, like piercings, deepenings, elevations and so on, which permit gripping with positive fit, by gripping arms in particular.

Further, the plate 21 can be grasped manually, in particular on the edges 28, 29 provided with the projecting gripping edge 30, 31. The gripping edge 30, 31 projecting beyond the upper side of the pipette tips 36 prevents contaminations of inserted pipette tips when this is done.

Figure 5:
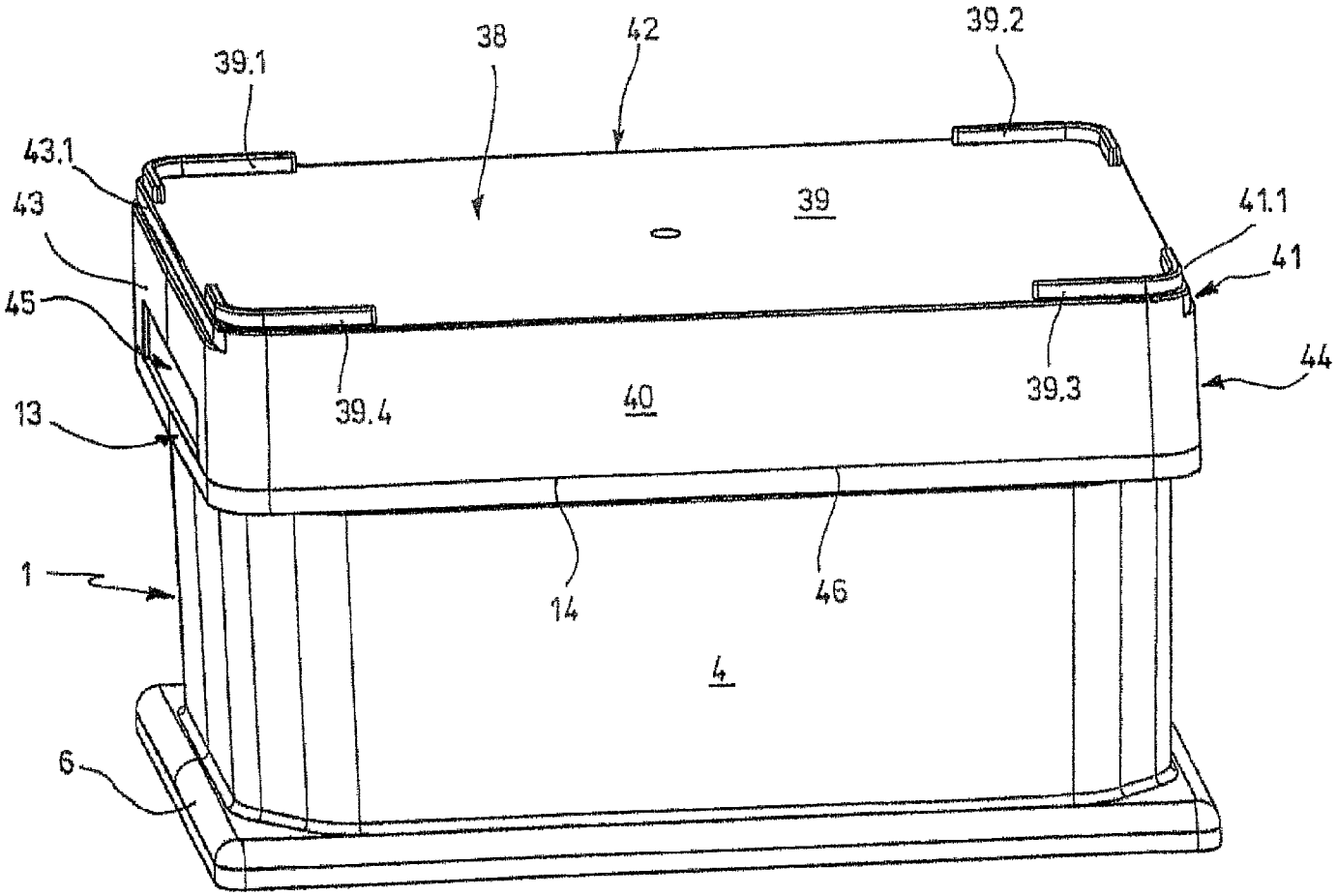
FIG. 5 the frame with plate being put up and cover cap being put up, in a perspective view at slant angle from the upside and from the side.
Figure 6:
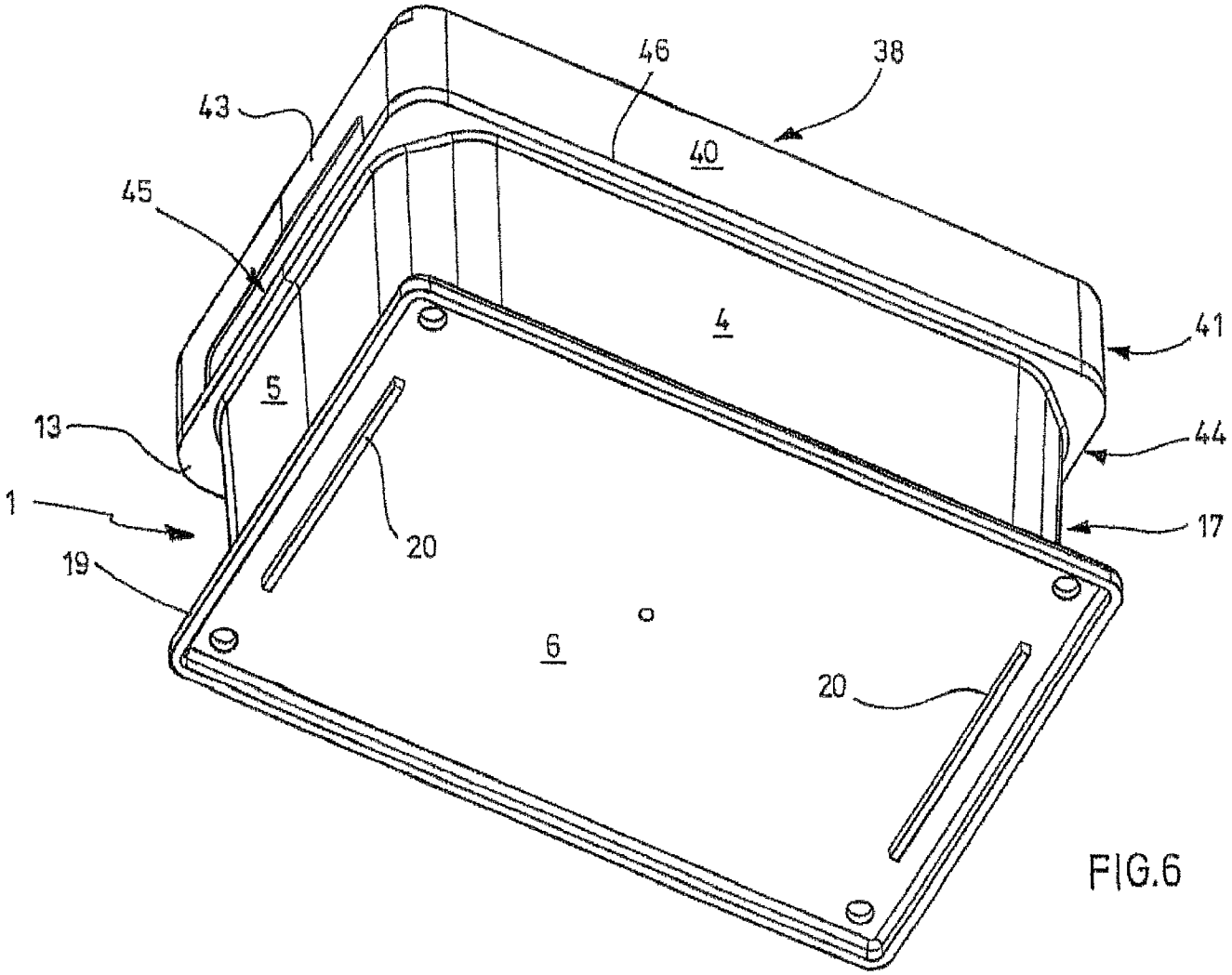
FIG. 6 the same arrangement, in a perspective view at slant angle from the downside and from the side.

According to FIGS. 5 and 6, a cover cap 38 has a flat cover cap bottom 39 and cover cap side walls 40 to 43 that laterally project downward from it. The opposing short cover cap side walls 41, 42 each have a deepening 44, 45. The cover cap side walls 40 to 43 sit on the step 14 with their lower edge 46. They are guided on the positioning noses 16 at their inner sides. The cover cap 38 covers up a plate 21 with inserted pipette tips 36 that is put onto the frame 1. The outer sides of the cover cap side walls 40 to 43 and the edge surface 15 are aligned with each other and can be used for attaching an adhesive tape, which sealingly connects the cover cap 38 with the frame 1.

A gripping tool can grasp into the deepenings 44, 45, in order to pull off the cover cap 38 automatically from the frame 1. Further, on a narrow side 26, 27 of the plate 21, a tag can be read through the deepenings from the outside. The cover cap 38 is preferably made of a transparent material for this purpose.

On the upper side of its bottom 39, the cover cap 38 has upwardly projecting ribs 39.1 to 39.4 on its corner region. Further, it has recesses 41.1, 43.1 on the upper edges of its cover cap side walls 41, 43. A frame 4 can be put onto the upper side of a top lid 38 with its bottom 6. At the inside, the enclosure 19 of the bottom 6 is guided on the ribs 39.1 to 39.4. Blade-shaped separation tools 43.2 can be inserted into the recesses 41.1, 43.1, in order to separate frames 1 and cover caps 38 that are arranged one above the other in a stack (compare FIG. 4).

The cover cap 38 is preferably made in one single piece. Plastic materials are used preferably. It is preferably injection moulded. For instance, the plastic materials polycarbonate (PC), polystyrene (PS), polypropylene (PP) or acrylonitrile-butadiene-styrene-copolymer (ABS) can be used. Preferably used is polycarbonate or polystyrene, because these materials permit the production of a cover cap 38 that is as clear as glass.

Figure 7:
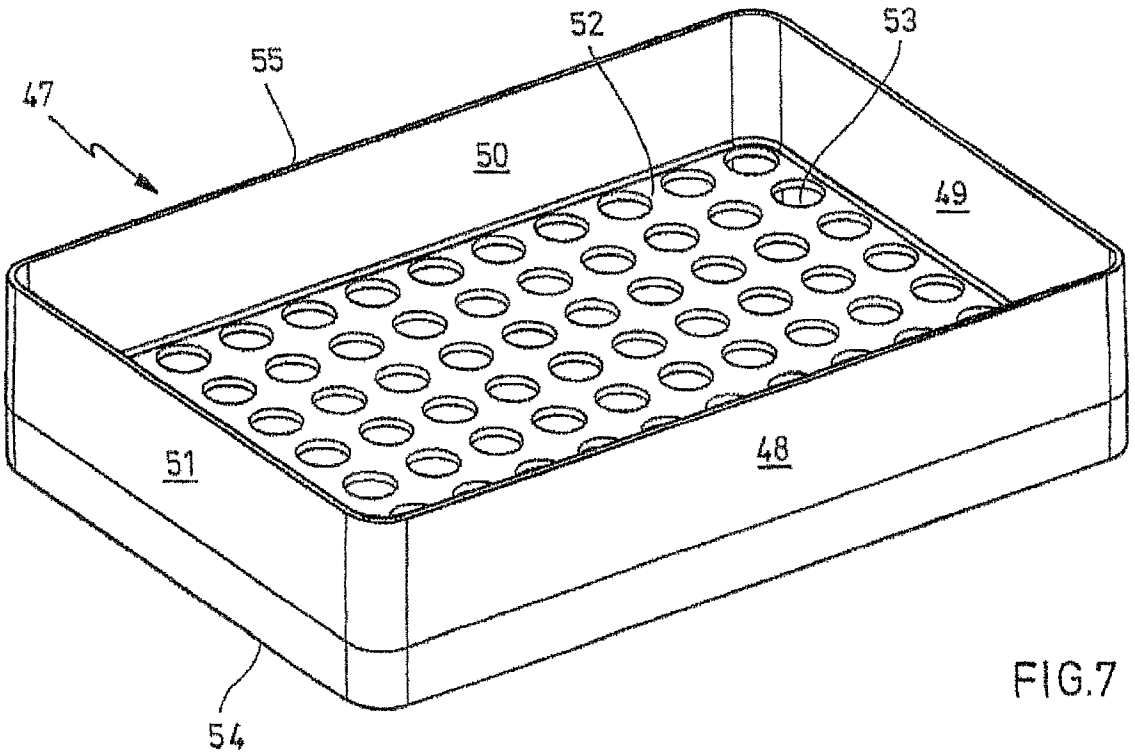
FIG. 7 a distance piece of the carrier, in a perspective view at slant angle from the upside and from the side.

According to FIG. 7, the carrier features a frame-shaped distance piece 47. The same has four vertical distance piece side walls 48 to 51, which are connected to each other on the corners. Further, the distance piece has an intermediate bottom 52 with 24, 48, 96, 383 or 1.536 further through holes 53, which are in a matrix arrangement corresponding to the holes 23 of the plate 21.

The distance piece 47 is preferably made in one single piece. Plastic materials are used preferably. It is preferably injection moulded. But it may also be produced as a deep-drawn piece. For instance, the plastic materials polypropylene (PP), polystyrene (PS), polycarbonate (PC), or acrylonitrile-butadiene-styrene-copolymer (ABS) can be used. Preferably used is polystyrene, because it is particularly cost-saving.

Figure 8:
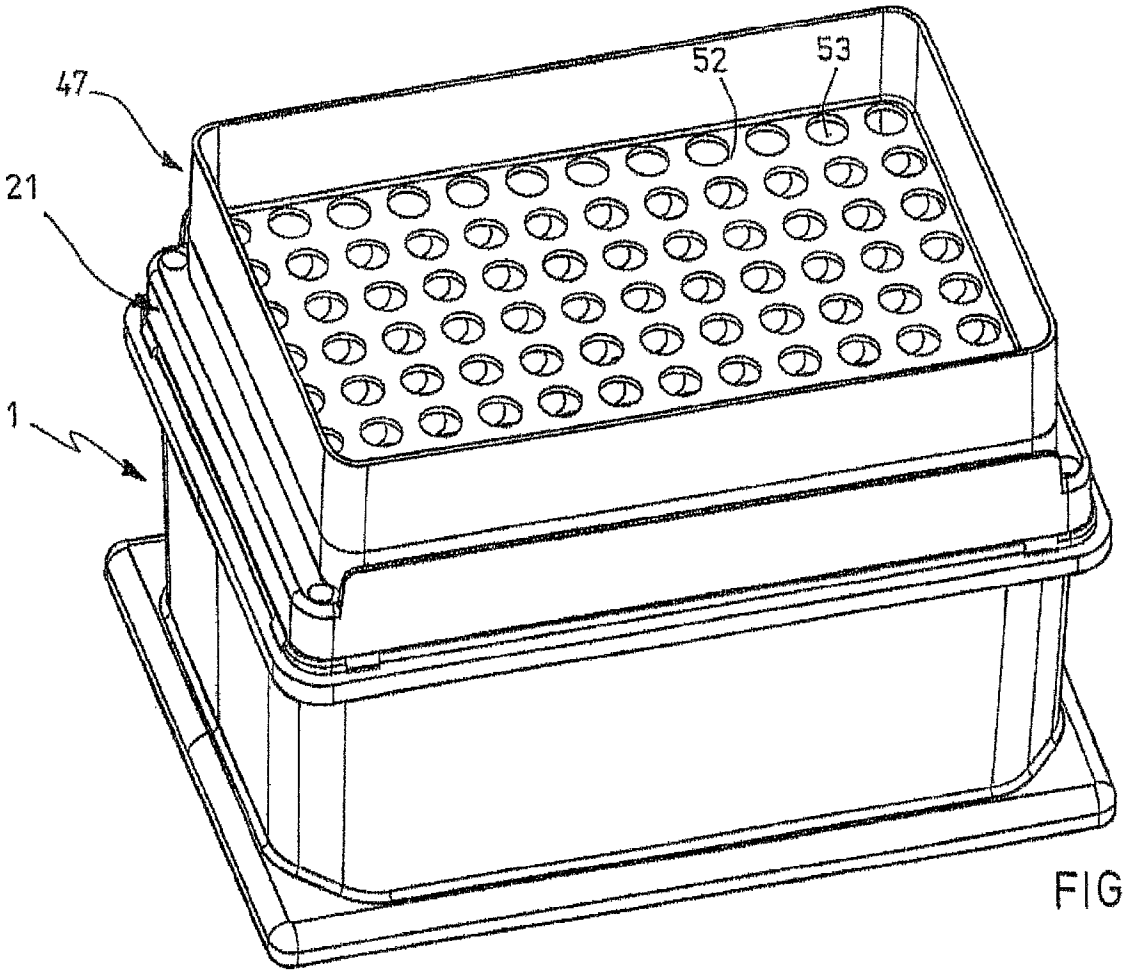
FIG. 8 the distance piece put onto an arrangement of a frame and a plate put up thereon, in a perspective view at slant angle from the upside and from the side.

According to FIG. 8, the distance piece 47 is put with its lower edge 54 onto the upper side of a plate 21 which is put onto a frame 1.

Figure 9:
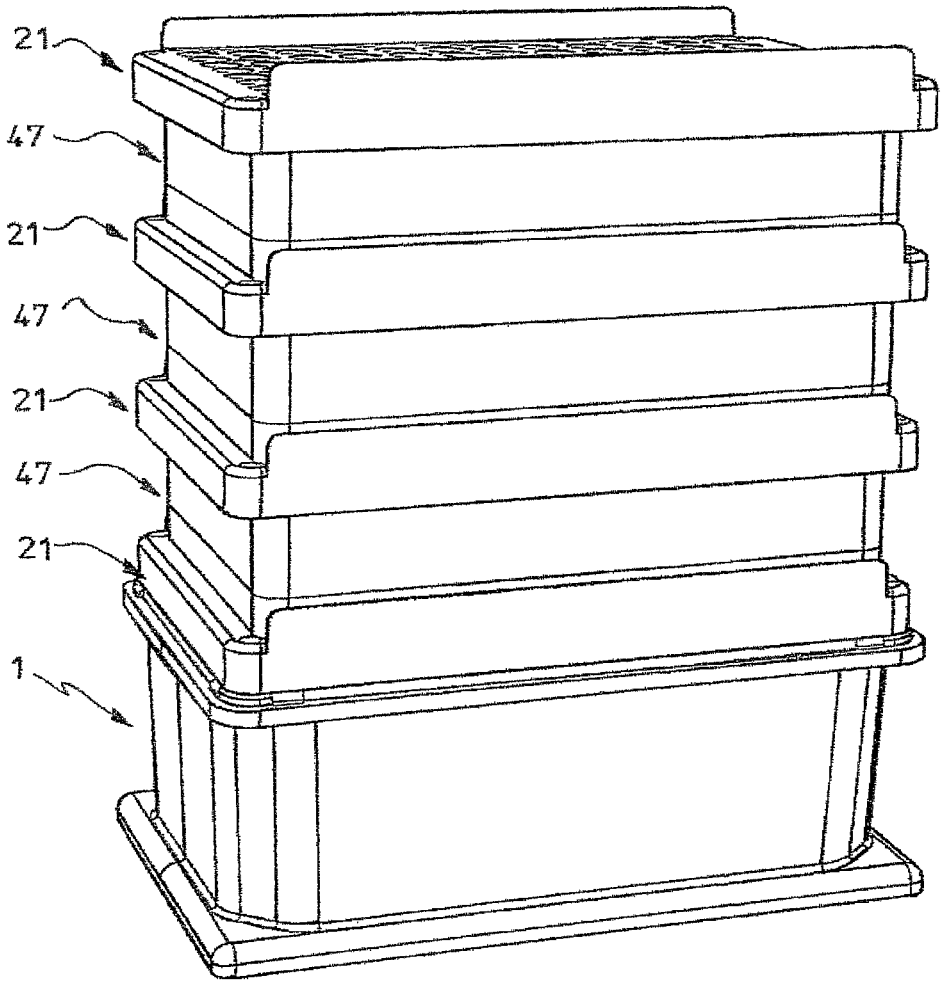
FIG. 9 a frame with several plates and distance pieces being put up thereon, in a perspective view from the side.

According to FIG. 9, a further plate 21 is put onto the upper edge 55 of the distance piece 47, and onto this plate a further distance piece 47 and so on.

Figure 10:
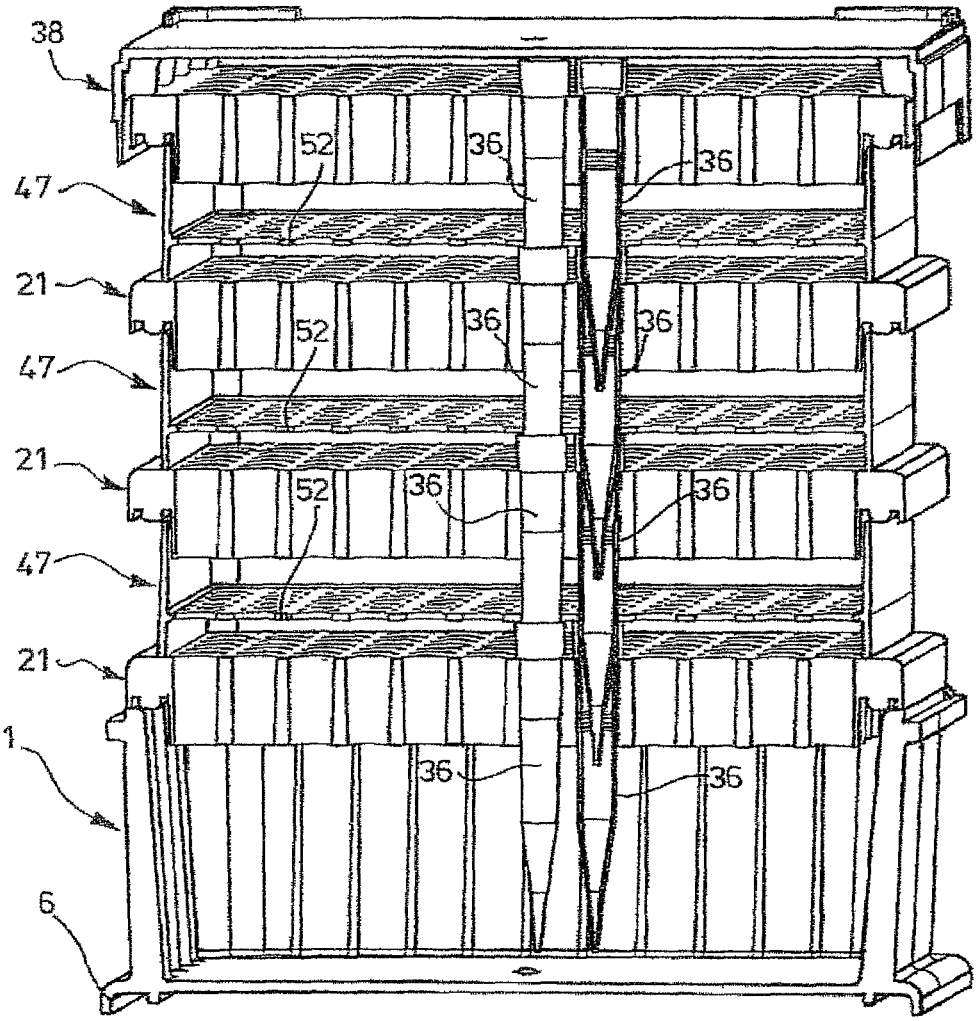
FIG. 10 a frame with several plates and distance pieces being put up, wherein the plate is filled with tips and a cover cap lays on the uppermost plate, in a perspective view from the side.

Pipette tips 36 that are inserted into the plate 21 are laterally guided by the further holes 33 of distance pieces 47 which are arranged in the intermediate bottoms below. Through this, erroneous alignments of pipette tips 36 in the automatic or manual stacking of filled plates 21 are avoided. When the plate 21 is lifted, the intermediate bottom 52 prevents pipette tips 36 from being taken along by plate 21 which disposed below. In order to cover up the arrangement, a cover cap 38 may be slackly put onto the uppermost plate 21 (compare FIG. 10).

Figure 15:
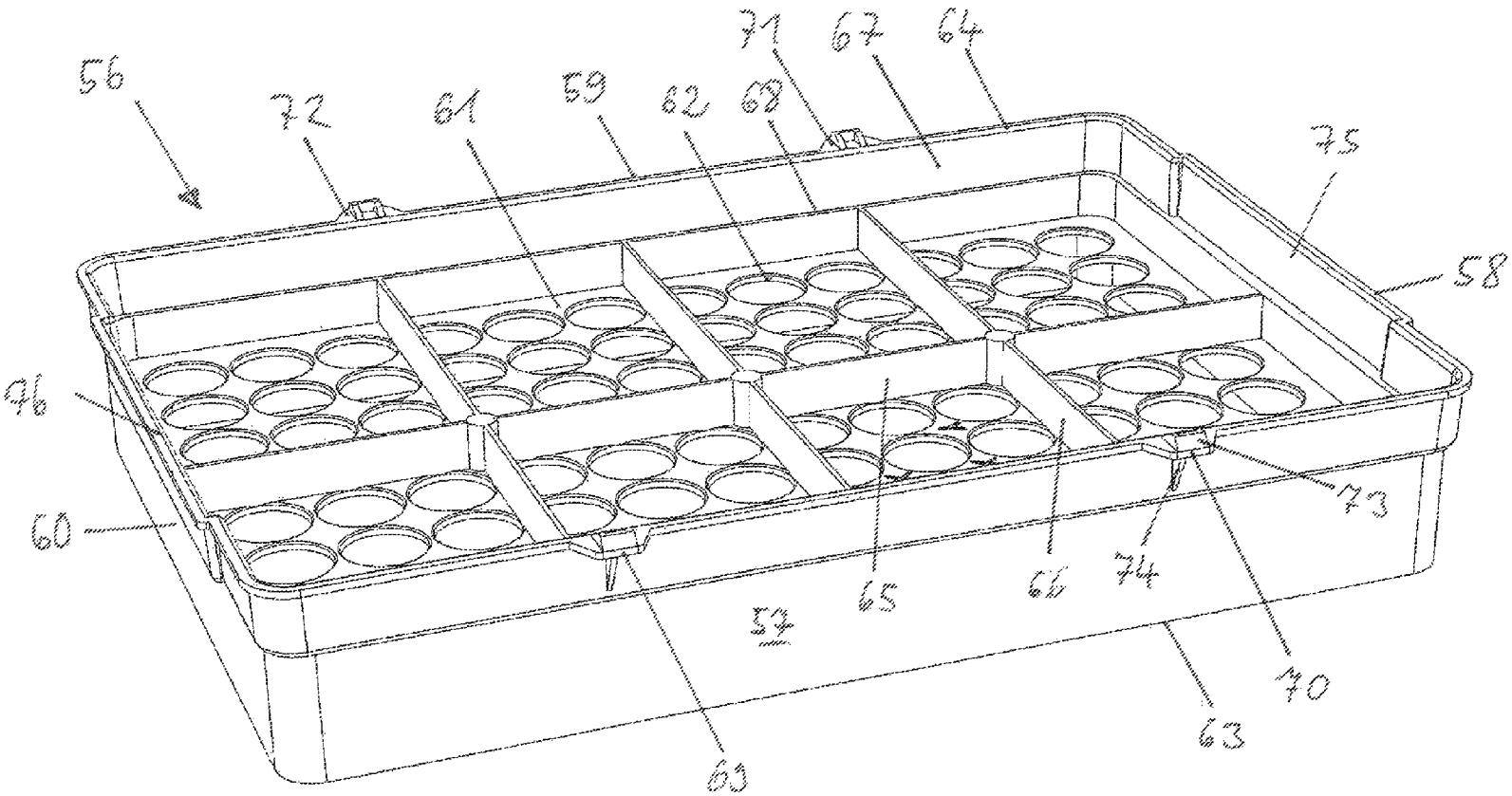
FIG. 15 a distance piece with distance piece side walls protruding from the intermediate wall on both sides in a perspective view at slant angle from the upside and from the side.
Figure 16:
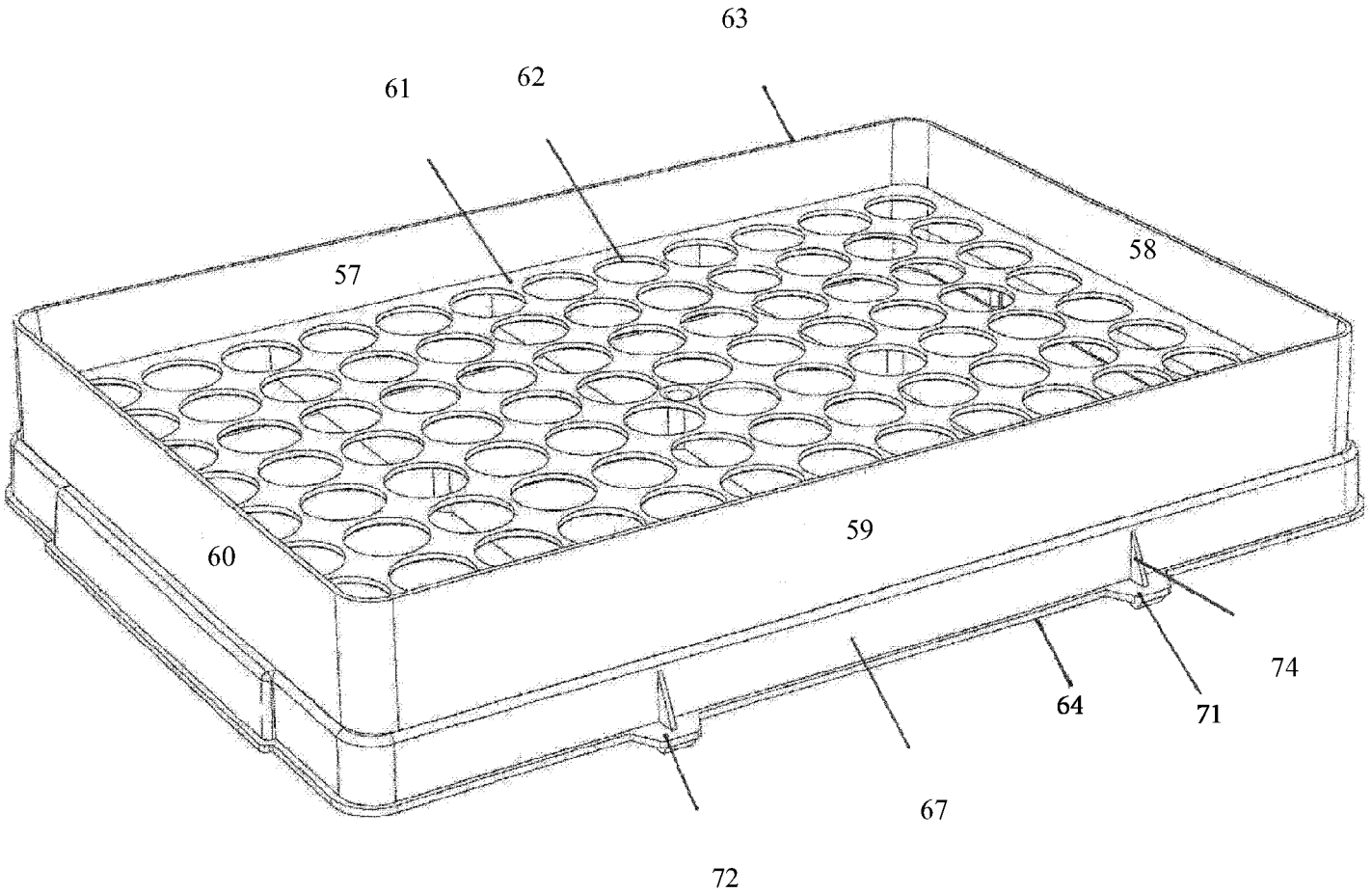
FIG. 16 the same distance piece in a perspective view at slant angle from the downside and from the side.

According to FIGS. 15 and 16, another distance piece 56 according to the invention has four distance piece side walls 57, 58, 59, 60 arranged in a frame-like manner. They are inter-connected at the corners and open towards the top.

Furthermore, the distance piece 56 has an intermediate bottom 61, which has a plurality of additional holes 62, which are arranged in rows and columns. There are preferably a total of 96 additional holes in 8 rows and 12 columns. The intermediate bottom is connected on its outer edge as one piece with the side walls 57, 58, 59, 60. The base area of the intermediate bottom 61 preferably corresponds to the base area of a microtiter plate according to the SBS standard.

The intermediate bottom 61 is arranged at a distance both from the lower edge 63 as well as from the upper edge 64 of the side walls 57 to 60.

The intermediate bottom 61 bears a grid of intersecting ribs 65, 66, each of which extend from a side wall 57, 58 to the opposite side wall 59, 60.

Parallel to the rows with additional holes 62, a single rib 65 runs in the middle over the intermediate bottom 61 between the additional holes 62. Parallel to the columns with additional holes 62, three ribs 66 run at even distances between the additional holes 62 over the intermediate bottom.

Next to the upper edge of the ribs 65, 66, the distance piece side walls 57 to 60 have an expansion 67 on the top. A step 68 runs there on the inside. A same distance piece 56 with the lower edge area of its distance piece side walls 57 to 60 is insertable into the expansion 67.

The distance piece 56 has respectively two outwardly protruding locking tabs 69, 70, 71, 72 on the upper edge 64 on the long side walls 57, 59. These locking tabs have a trapezoidal contour in the horizontal plane, wherein they taper outwards. On the top side, the locking tabs bear insertion chamfers 73, each of which tilt upwards and towards the center of the distance piece. Stiffening ribs 74 are located on the bottom side between the locking tabs and the long side walls.

The two short side walls 58, 60 have outwardly protruding pockets 75, 76 on the upper edge 64 in the area of the expansion 67.

Figure 17:
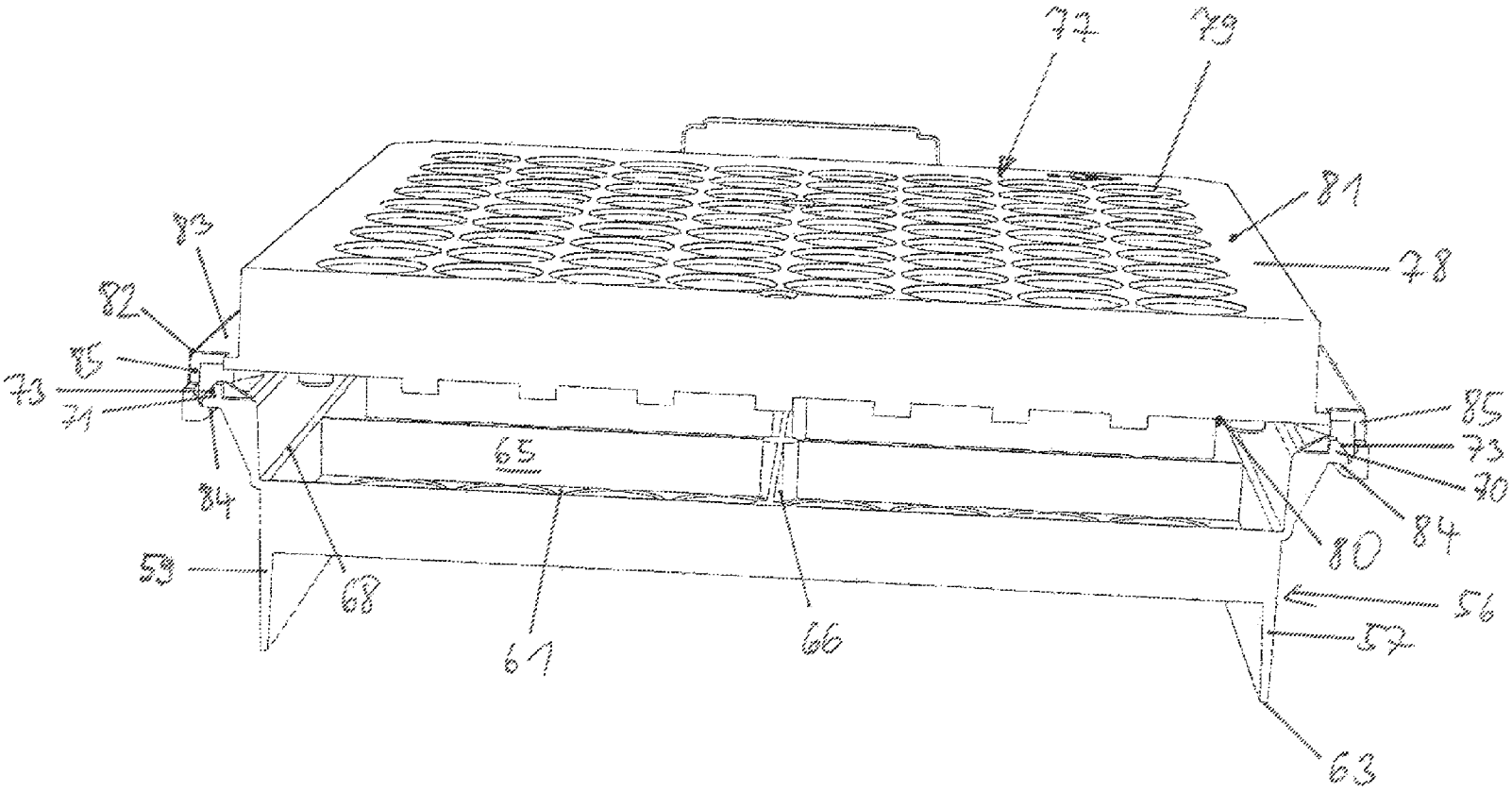
FIG. 17 a plate locked with the same distance piece in a vertical section through the locking elements.
Figure 18:
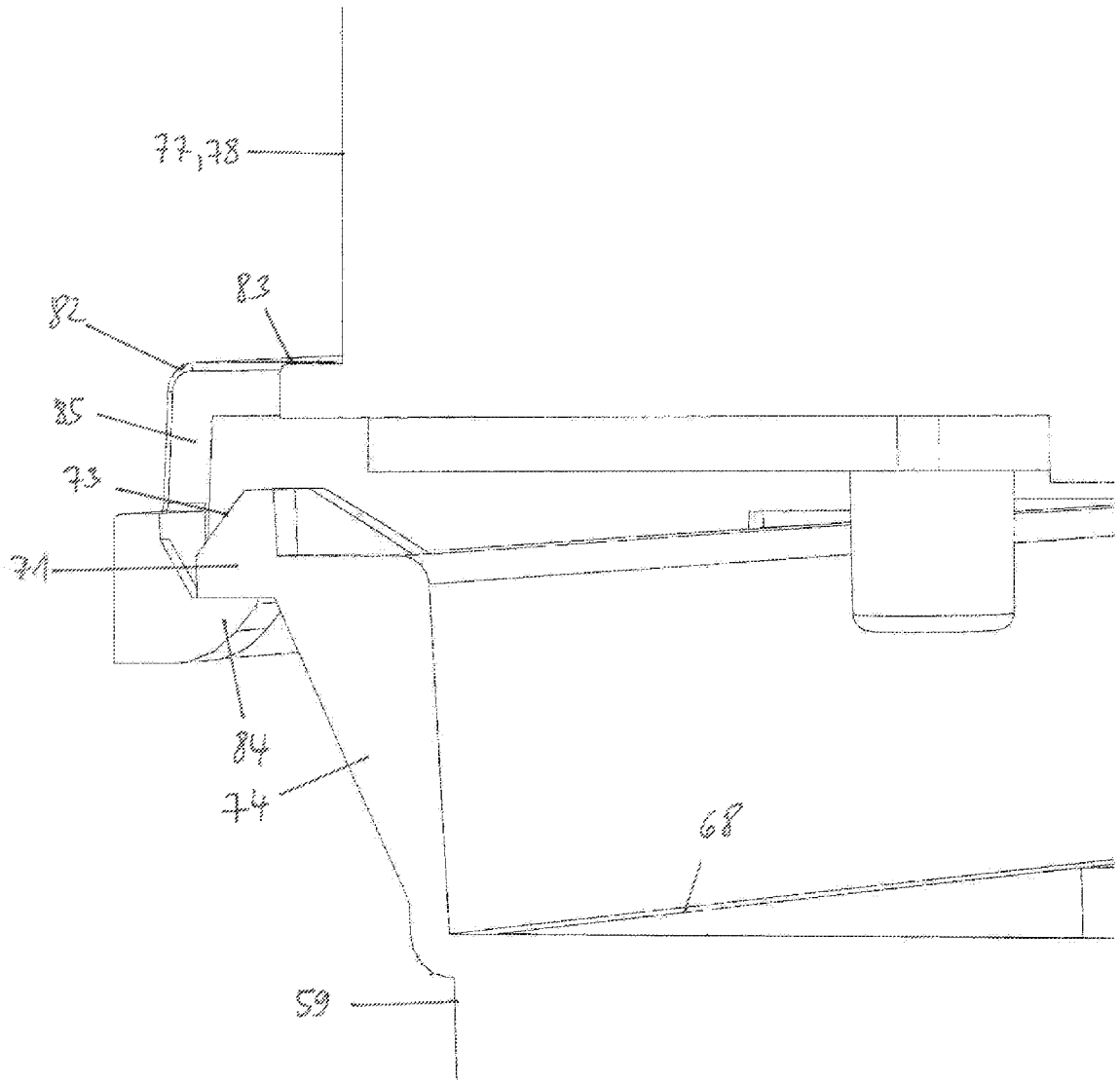
FIG. 18 the locking of plate and distance piece in an enlarged detail section.

According to FIGS. 17 and 18, a plate 77 has a substantially plate-shaped base body 78 with a plurality of holes 79, which extend from the bottom side 80 to the top side 81 of the base body 78.

The holes 79 are also arranged regularly in rows and columns. In the example, there are 96 holes in eight rows and twelve columns. The base area of the plate 77 corresponds to the base area of a microtiter plate according to the SBS standard.

A circumferential edge area 82 protrudes from the lower edge of the plate-shaped base body 78 in an apron-like manner to the side and downwards. Starting from the lower edge, the edge area 82 first extends horizontally to the side and then subsequently vertically upwards. The top side of the edge area 82 forms a step 83 onto which a hood-like cover is placeable from above.

Additional locking tabs 84 protrude inwardly from the inside of the downwardly protruding part of the edge area 82. The additional locking tabs 84 are located for production reasons below or respectively next to breakouts 85 in the connection area of the horizontal and vertical section of the edge area 82.

The additional locking tabs 84 are lockable with the locking tabs 69, 70, 71, 72 of the distance piece 56. For this, the additional locking tabs are pressed onto the insertion chamfers 73 of the locking tabs 69 to 72 until they snap over the outer edge of the locking tabs 69 to 72 and engage below them. In this position, the upper edge 64 of the side walls 57 to 60 lies on the bottom side 80 of the plate-shaped base body 78 and is supported on it. The locking connection is easily releasable outwardly in a targeted manner by bending the edge area 82.

Pipette tips can be inserted into the locked unit made up of plate 77 and distance piece 56, wherein each pipette tip 86 is supported on the top with a head 87 on the edge of the hole 79 of the plate 77 and is guided on the bottom on the periphery in an additional whole 62 of the distance piece 56 arranged below it.

Figure 19:
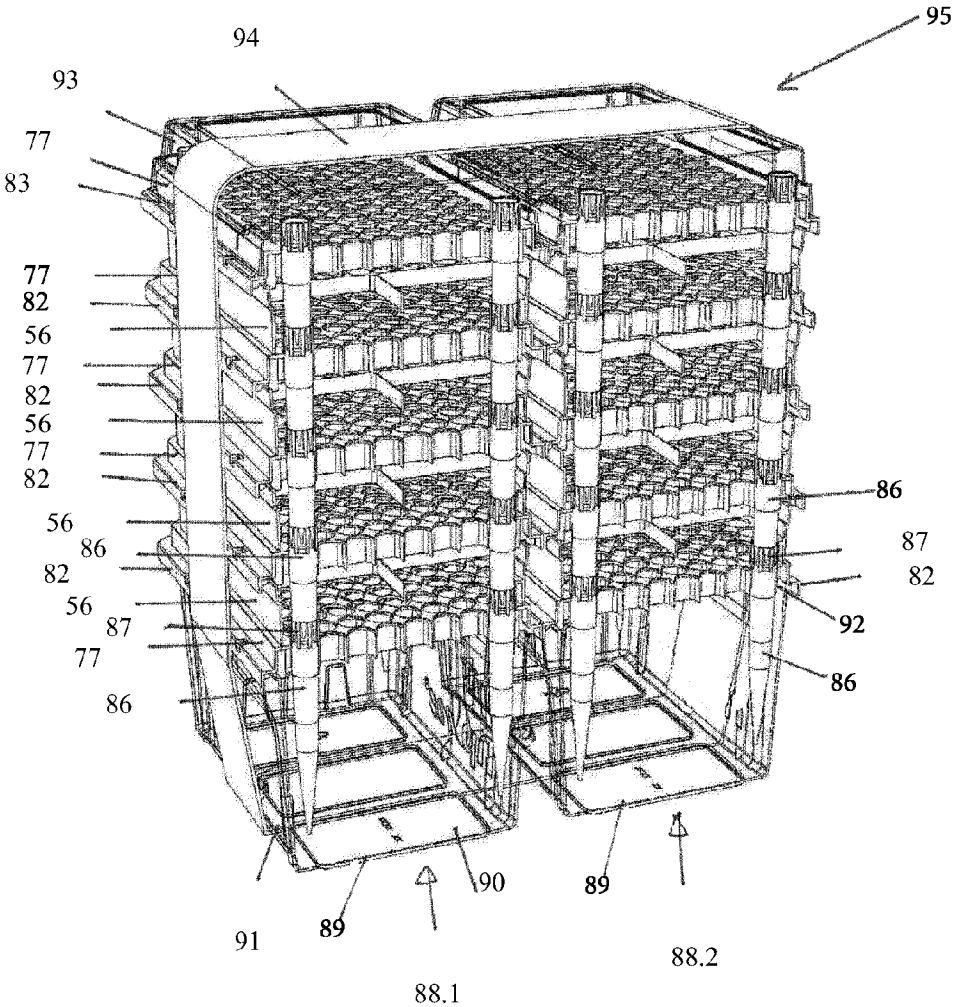
FIG. 19 a sales unit comprising two stacks in each case with a box, distance pieces, plates and pipette tips and a strap surrounding both stacks in a sectional perspective view at slant angle from the upside and from the side.

FIG. 19 shows an Arrangement of two stacks with a total of 960 pipette tips, wherein only a few pipette tips 86 are shown as an example due to overview reasons. Each pipette tip 86 has cylindrical and conical sections. As a result, only a short, lower section of a pipette tip 86 can be pushed into a short, upper section of a same pipette tip 86.

Each stack 88.1, 88.2 has a crate or box 89 with a bottom wall 90 and four side walls 91 on the bottom. On the upper edge, each box 89 has a circumferential resting edge 92. A plate 77 is placed with the edge area 82 on the resting edge 92 so that it overlaps the resting edge 92 and the outsides.

A locked arrangement made up of plate 77 and distance piece 56 according to FIGS. 17 and 18 is placed on the lower plate 77, wherein the distance piece 56 with the lower edges 63 of its side walls 57 to 60 is supported on the top side 81 of the lower plate 77. The insides of the side walls 57 to 60 of the distance piece 56 are guided laterally on the heads 87 of the outer pipette tips 86. The pipette tips 86 held in the upper plate 77 engage with their lower ends in the upper ends of the pipette tips 86 held in the lower plate 77.

Additional arrangements made up of interlocking plates 77 and distance pieces 56 are placed on the previously described arrangement, wherein respectively the lower edge 63 of the distance piece 56 is supported on the top side 81 of the lower plate 77 and is guided on the inside on the heads 87 of the pipette tips 86 in the lower plate 77. A hood-like cover 93 is placed on the uppermost plate 77 of each stack 88.1, 88.2. It is supported with the lower edges of its circumferential side walls on the step 83 of the uppermost plate 77. Two stacks 88.1, 88.2 are placed next to each other and enclosed by a strap 94 in order to hold this arrangement together. In the example, the two boxes 89 are originally separate. But it is also possible to provide two boxes 89 interconnected as one piece in order to further stabilize the arrangement.

Furthermore, the entire arrangement is enclosed in a shrink-wrap film, which further reinforces and protects the arrangement from contamination.

Figure 20:
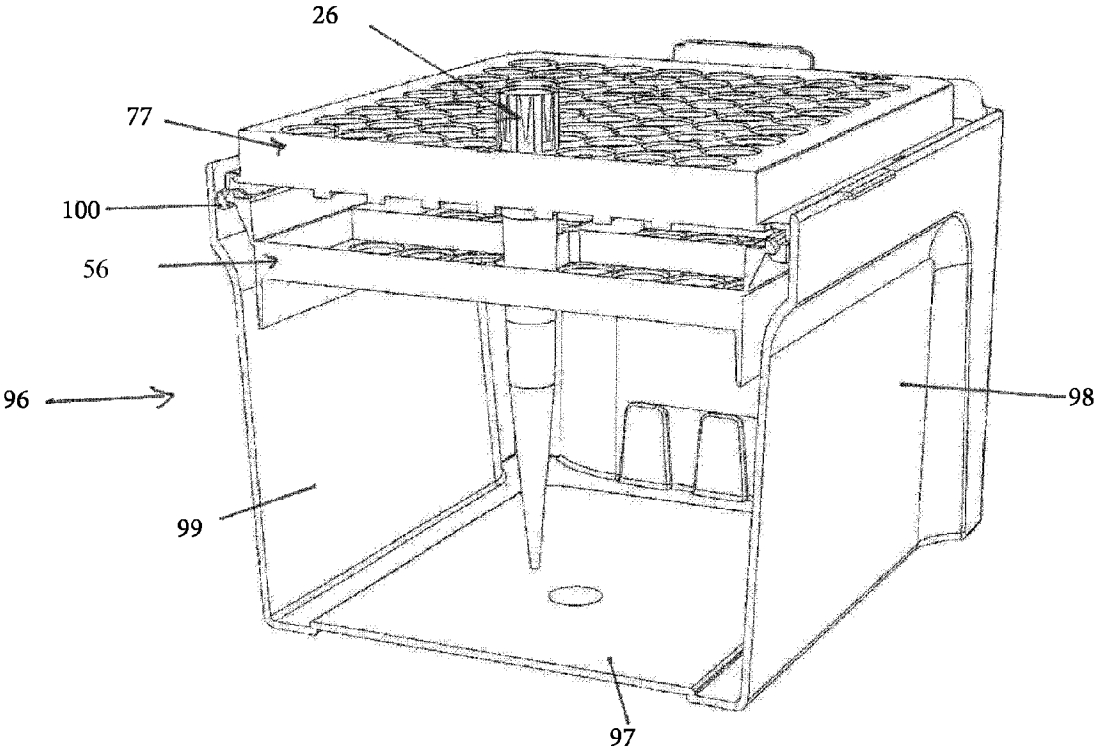
FIG. 20 a plate with a pipette tip and a distance piece locked therewith inserted into a work box in a sectional perspective view at slant angle from the upside and from the side.

This packaging unit 95 is opened for the discharging of pipette tips. An individual refill package consisting of plate 77, interlocked distance piece 56 and pipette tips 86 is removed from above and transferred to a work box 96. This is shown in FIG. 20.

The work box 96 also has a bottom wall 97 and four upwards projecting side walls 98. On the inner periphery of the side walls, a resting edge 100 runs at a short distance from the upper opening of a receiver 99 of the work box 96. The plate 77 is supported with the lower edge area 82 on the resting edge 100. The distance piece 56 protrudes into the receiver 99 of the work box 96.

The work box 96 also has a bottom wall 97 and four upwards projecting side walls 98. On the inner periphery of the side walls, a resting edge 100 runs at a short distance from the upper opening of a receiver 99 of the work box 96. The plate 77 is supported with the lower edge area 82 on the resting edge 100. The distance piece 56 protrudes into the receiver 99 of the work box 96.

The pipette tips 86 are removable from this arrangement individually or in groups by means of a pipette. For this, the pipette with at least one conical or cylindrical nose is pressed into the upper opening of at least one pipette tip 86 and the pressed on pipette tip 86 is raised by means of the pipette. After all pipette tips 86 have been used up, plate 77 and distance piece 56 can be removed from the work box 96 and can be disposed of separately from each other.

Figure 21:
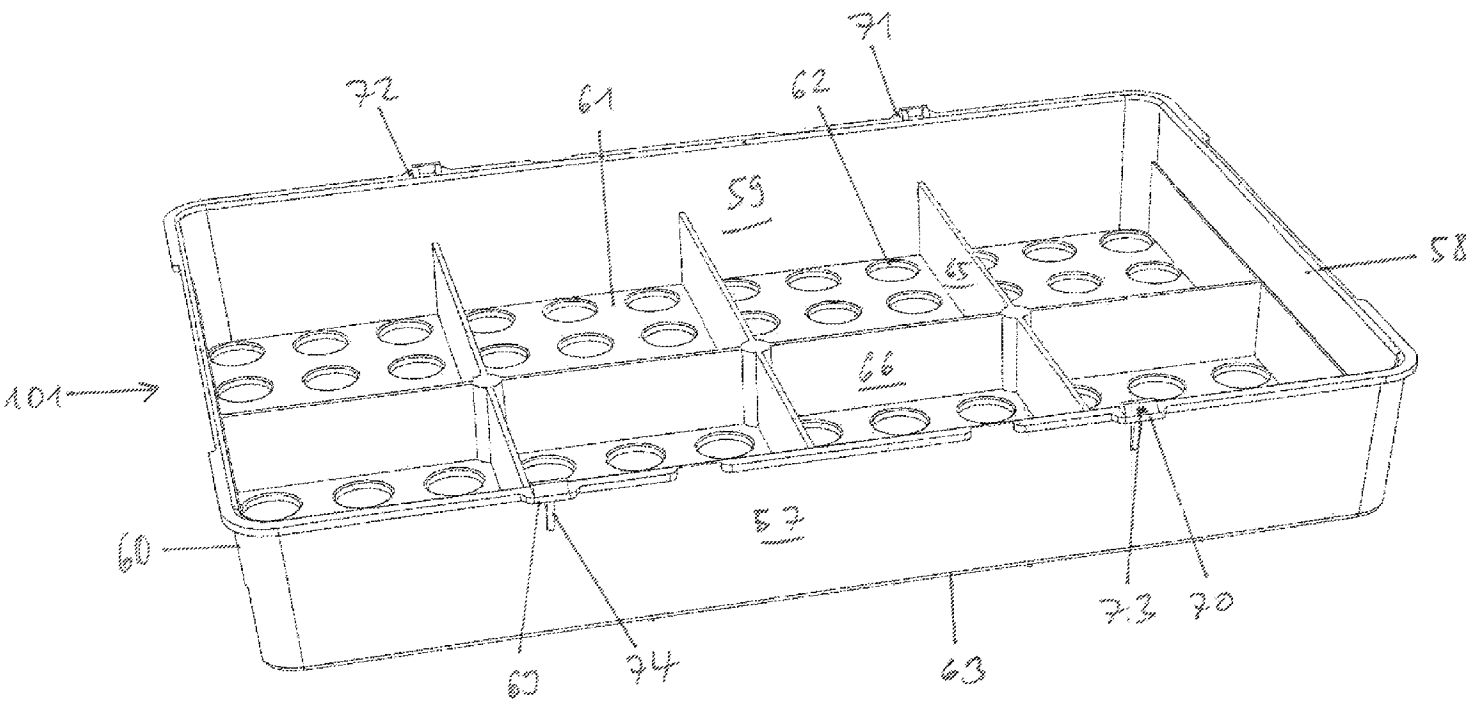
FIG. 21 another distance piece with the intermediate bottom on the lower side in a perspective view at slant angle from the upside and from the side.
Figure 22:
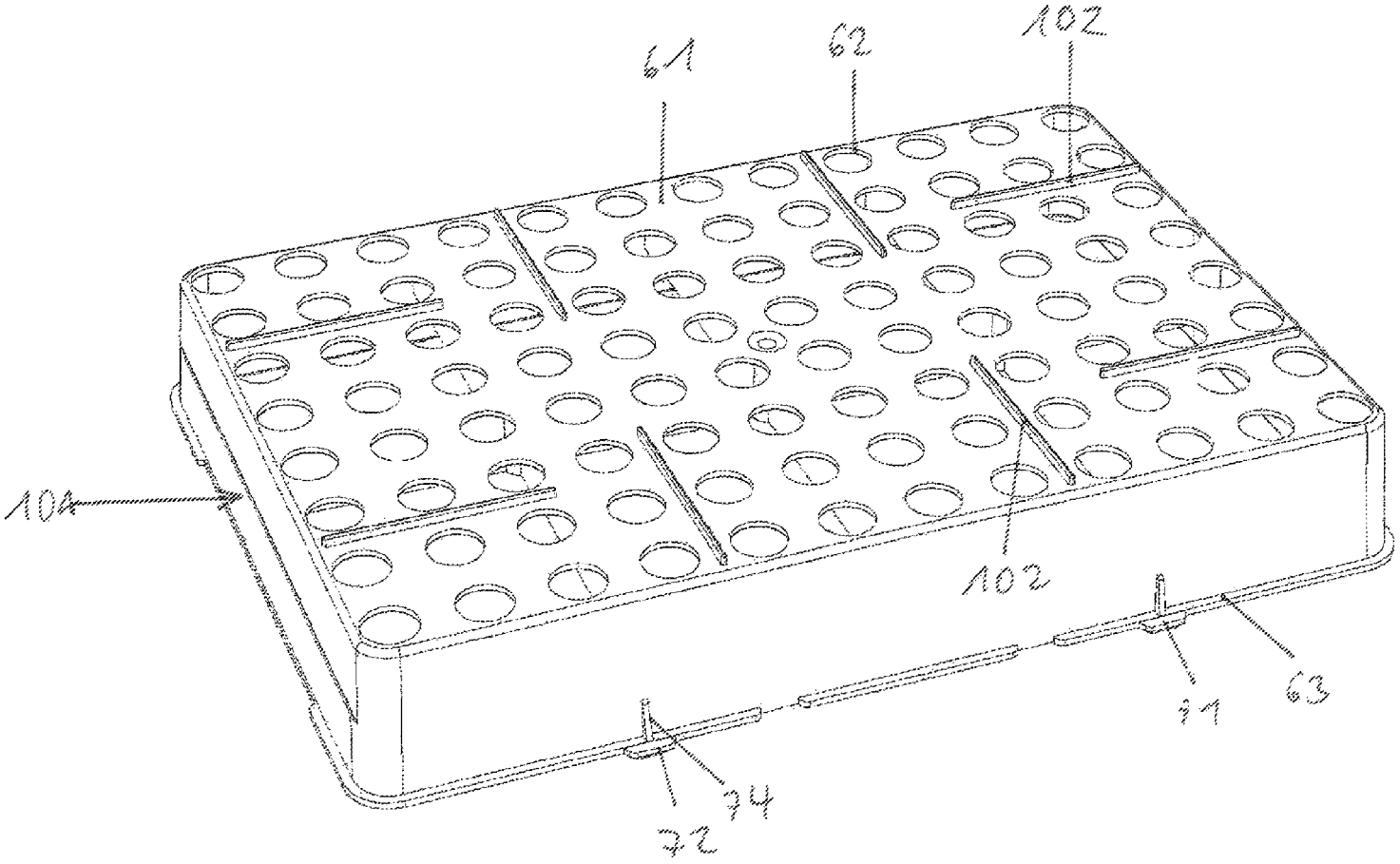
FIG. 22 the same distance piece in a perspective view at slant angle from the downside and from the side.

Compared to the distance piece 56 described above, the distance piece 101 in FIGS. 21 and 22 has an intermediate bottom 61, which is connected with the lower edge 63 of the side walls 57 to 60. As a result, the side walls 57 to 60 do not protrude downwards from the intermediate bottom 61.

The top side of the intermediate bottom 61 is in turn provided with ribs 65, 66 for stiffening. A expansion 67 above the upper edge of the rib 66 only has the short side walls 58, 60.

The intermediate bottom 61 has downwardly protruding guiding elements 102 in the form of strip-like projections on the bottom side between the additional holes 62. They extend respectively starting from the edge of the intermediate bottom 61 along three additional neighboring holes 62. An extension along a greater or smaller number of additional holes 62 is also possible. Two guiding elements 102 emanate from each side. They serve to guide on the edge the heads 87 of pipette tips 86, which are provided in a plate 77 below the distance piece 56.

Figure 23:
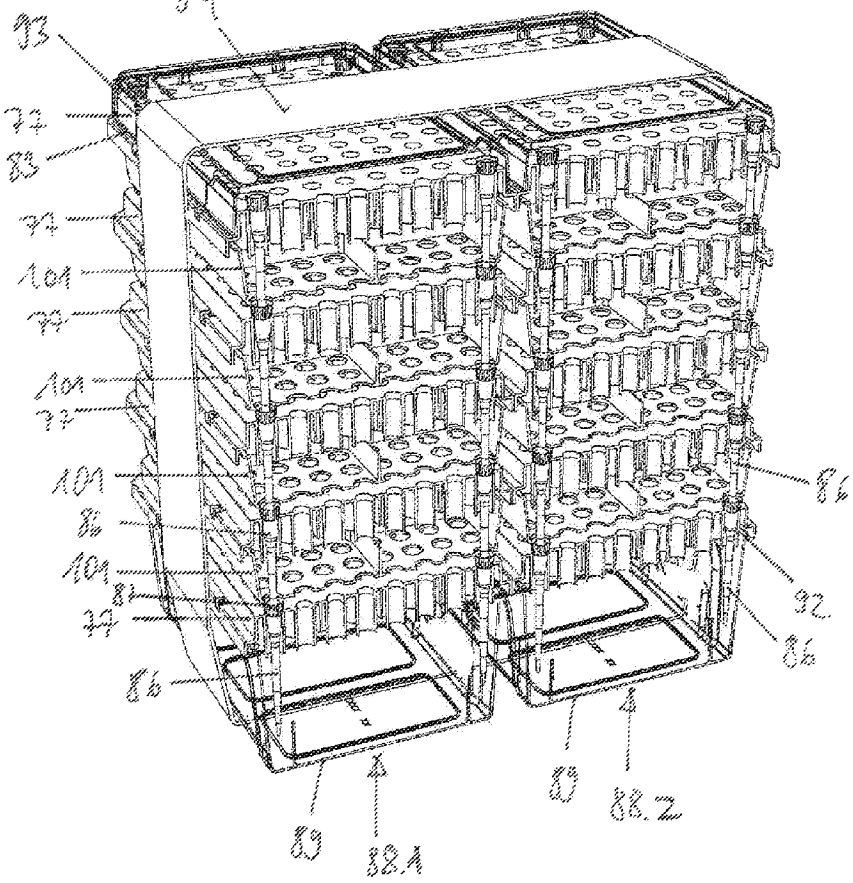
FIG. 23 a sales unit comprising two stacks in each case with a box, distance pieces according to FIGS. 21 and 22, plates and pipette tips and a strap surrounding both stacks in a sectional perspective view at slant angle from the upside and from the side.

FIG. 23 shows a packaging unit with two stacks 88.1, 88.2. Each stack 88.1, 88.2 comprises a box 89, onto which a plate 77 with the edge area 82 is placed. Pipette tips 86, which engage in the receiver of the box 89, are held in the plate 77. Several arrangements made up of the distance piece 101 according to FIGS. 21 and 22 and an interlocked plate 77 is placed on this arrangement. The distance piece 101 is supported respectively with the lower edge of its additional holes 62 on the top side of one of the heads 87 of pipette tips 86, which are held on a lower plate 77. Respectively, pipette tips 86, which partially engage in the pipette tips 86, which are held in the lower plate 77, are held in the upper plate 77. Each stack 88.1, 88.2 comprises distance piece 56 and five plates 77. A hood-like cover 93, which is supported on the step 83 of the uppermost plate, is placed on the uppermost plate 77.

Both stacks 88.1, 88.2 are held together and stabilized by a strap 94. The lowermost boxes 89 can in turn be separated boxes or boxes that are combined together as one piece. The entire arrangement is surrounded by shrink-wrap film.

After opening the packaging and removing the cover 93, individual arrangements can in turn be removed from above from plate 77 and distance piece 56 and inserted into a work box 96. Individual pipette tips 86 are removed from the work box 96. After a plate 77 has been used up, it can in turn be separated from distance piece 56 and the two parts can be disposed of separately from each other.

An alternative embodiment identified as embodiment 1 includes: A carrier for pipette tips, with

- a frame (1), featuring four side walls (2 to 5),
- a plate (21) with a plurality of holes (23) for inserting pipette tips (36) and
- means for detachably connecting the frame (1) and the plate (21),
- that have contact surfaces (8, 32) on the upper edge (7) of the frame (1) and on the underside (24) of the plate (21), which touch each other when the plate is put onto the frame (1), and
- that have guiding elements (9, 33) directed transversally to the contact surfaces on the frame (1) and on the plate (21), which engage into each other with lateral clearance when the plate (21) is put onto the frame (1).

An alternative embodiment identified as embodiment 2 includes: A carrier for pipette tips according to alternative embodiment 1, wherein the guiding elements (9, 33) are arranged at opposing side walls (2 to 5) of the frame (1) and at opposing edges of the plate (21).

An alternative embodiment identified as embodiment 3 includes: A carrier according to alternative embodiments 1 or 2, wherein the guiding elements are adapted to be brought into engagement with each other with lateral clearance feature columns (9), and bores (33) suited for insertion of the columns with lateral clearance, and/or ribs and grooves that are suited for insertion of the ribs with lateral clearance.

An alternative embodiment identified as embodiment 4 includes: A carrier according to alternative embodiment 3, wherein the columns (9) and/or the ribs project from the upper edge (7) of the frame (1) and the plate feature the bores (33) and/or grooves in the underside (24).

An alternative embodiment identified as embodiment 5 includes: A carrier according to any one of alternative embodiments 1 to 4, wherein the columns (9) and/or ribs taper at least in sections in the direction towards their free end, and/or wherein the bores (33) and/or grooves widen up at least in sections in the direction towards their insertion openings for the columns (9) and/or ribs.

An alternative embodiment identified as embodiment 6 includes: A carrier according to any one of alternative embodiments 3 to 5, wherein the columns (9) and the bores (33) are disposed on the corners of the frame (1) and the plate (21).

An alternative embodiment identified as embodiment 7 includes: A carrier according to any one of alternative embodiments 1 to 6, wherein the frame (1) features a waistline (17).

An alternative embodiment identified as embodiment 8 includes: A carrier according to alternative embodiment 7, wherein the waistline (17) is limited at the upside by an outwardly protruding upper projection (13), and/or at the downside by an outwardly protruding lower projection (6), respectively, of the frame (1).

An alternative embodiment identified as embodiment 9 includes: A carrier according to any one of alternative embodiments 1 to 8, wherein the frame (1) is closed by a bottom (6) at its underside.

An alternative embodiment identified as embodiment 10 includes: A carrier according to any one of alternative embodiments 1 to 9, wherein the dimensions of the ground area of the frame (1) coincide with the dimensions of the ground area of microtiter plates according to the standard of the Society for Biomolecular Screening (SBS).

An alternative embodiment identified as embodiment 11 includes: A carrier according to any one of alternative embodiments 1 to 10, wherein the frame (1) has a free cross section between the side walls (2 to 5).

An alternative embodiment identified as embodiment 12 includes: A carrier according to any one of alternative embodiments 1 to 11, wherein the plate (21) features a gripping edge (30, 31) projecting beyond the upper side of the plate on each one of at least two opposite edges (28, 29).

An alternative embodiment identified as embodiment 13 includes: A carrier according to any one of alternative embodiments 1 to 12, with a cover cap (38) that is adapted to be set up slackly, having a cover cap bottom (39) and cover cap side walls (40 to 43) projecting towards the downside from the edge of the cover cap bottom which can be put onto the frame (1).

An alternative embodiment identified as embodiment 14 includes: A carrier according to alternative embodiment 13, wherein the upper edge (7) of the frame (1) has a circumferential shoulder (14) on the outside onto which the cover cap (38) can be put with the lower edge (46) of the cover cap side walls (40 to 43).

An alternative embodiment identified as embodiment 15 includes: A carrier according to alternative embodiment 14, wherein the frame (1) has an edge surface (15) limiting the shoulder (14) at the outside, which is aligned with a further edge surface that limits at least the lower edge (46) of the cover cap side walls (40 to 43) at the outside when the cover cap (38) is put up.

An alternative embodiment identified as embodiment 16 includes: A carrier according to alternative embodiment 15, wherein the dimensions of the ground area of the frame (1) exceed the outer dimensions of the frame (1) in the region of the edge surface (15).

An alternative embodiment identified as embodiment 17 includes: A carrier according to any one of alternative embodiments 9 to 16, wherein the bottom (6) is a hollow bottom having a downwardly projecting enclosure (19), the bottom being adapted to be put onto the upper edge (7) of the cover cap (38).

An alternative embodiment identified as embodiment 18 includes: A carrier according to any one of alternative embodiments 12 to 17, wherein the cover cap (38) features deepenings (44, 45) in the outer sides of two opposing cover cap side walls (41, 43).

An alternative embodiment identified as embodiment 19 includes: A carrier according to any one of alternative embodiments 1 to 18, with a frame-shaped distance piece (47), which is adapted to be put onto the upper side of a plate (21) with its lower edge (54) outside of the holes (23), and with its upper edge (55) onto the lower side of a plate (21) outside of the holes (23).

An alternative embodiment identified as embodiment 20 includes: A carrier according to alternative embodiment 19, wherein the distance piece has an intermediate bottom (52) with a plurality of holes (53) for inserting pipette tips (36).

An alternative embodiment identified as embodiment 21 includes: The utilisation of a carrier according to any one of alternative embodiments 1 to 20 in an automatic machine.

An alternative embodiment identified as embodiment 22 includes: A distance piece for holding an upper plate (77) with a plurality of holes (79) for inserting pipette tips spaced from a lower plate (77) with a plurality of holes (79) for holding pipette tips (86), wherein the distance piece (56) is frame-shaped, has an intermediate bottom (61) with a plurality of additional holes (62) for the lateral guiding of pipette tips (86), can be placed onto the bottom side (80) of the upper plate (77) with its top side (64) outside of the holes (79) and can be placed with its bottom side (63) onto the top side (81) of the lower plate (77) or of pipette tips (86) held in the lower plate.

An alternative embodiment identified as embodiment 23 includes: The distance piece according to alternative embodiment 22, which has distance piece side walls (57 to 60) opening towards the top such that several same distance pieces (56) are stackable into each other.

An alternative embodiment identified as embodiment 24 includes: The distance piece according to alternative embodiments 22 or 23, which has locking elements (69 to 72) on the upper edge, which are lockable with locking elements (84) on the bottom side of the upper plate (77).

An alternative embodiment identified as embodiment 25 includes: The distance piece according to alternative embodiment 24, which has on the upper edge (64) locking tabs (69 to 72) with insertion chamfers (73) protruding outward from at least two opposite distance piece side walls (57, 59) for locking behind locking edges on an apron-like downwardly protruding edge area (82) of the upper plate (77).

An alternative embodiment identified as embodiment 26 includes: The distance piece according to alternative embodiment 25, in which stiffening ribs (74) are arranged between the locking tabs (69 to 72) and distance piece side walls (57 to 60).

An alternative embodiment identified as embodiment 27 includes: The distance piece according to one of alternative embodiments 22-24, in which the intermediate bottom (61) bears ribs (65, 66) on the top side between the holes, which extend from a distance piece side wall (57 through 60) to the opposite distance piece side wall (57 to 60).

An alternative embodiment identified as embodiment 28 includes: The distance piece according to alternative embodiment 27, in which the intermediate bottom (61) bears intersecting ribs (65, 66).

An alternative embodiment identified as embodiment 29 includes: The distance piece according to one of alternative embodiments 22-28, which has guiding elements (57 to 60; 102) protruding downwards and/or upwards from the intermediate bottom (61) for the lateral guiding on pipette tips (86), which are held in a lower and/or upper plate (77).

An alternative embodiment identified as embodiment 30 includes: The distance piece according alternative embodiment 29, in which the guiding elements comprise lower and/or upper sections of distance piece side walls (57 through 60), which protrude in an apron-like manner downwards and/or upwards from the intermediate bottom (61) in order to support themselves on the top side (81) and/or the bottom side (80) of a lower and/or upper plate (77) and to be guided on the inside on the periphery of pipette tips (86), which are inserted near the edge into the lower and/or upper plate (77).

An alternative embodiment identified as embodiment 31 includes: The distance piece according to alternative embodiments 29 or 30, in which the intermediate bottom (61) bears guiding elements (102) protruding on the bottom side between the holes (62).

An alternative embodiment identified as embodiment 32 includes: The distance piece according to alternative embodiment 31, in which the guiding elements (102) are strip-like projections.

An alternative embodiment identified as embodiment 33 includes: The distance piece according to alternative embodiments 31 or 32, in which the intermediate bottom (61) is connected with the lower edge (63) of the side walls (57 to 60).

An alternative embodiment identified as embodiment 34 includes: A carrier for pipette tips with

- a frame or box (89) having four side walls,
- several plates (77) with a plurality of holes (79) for inserting pipette tips (86),
- pipette tips (86) inserted into the holes (79) of the plates (77),
- means for releasably connecting (82, 92) the frame or box (89) with a plate (77),
- a lower plate (77), which is connected via the means for releasably connecting with the frame or the box (89),
- a distance piece (56) placed with the bottom side (63) on the upper plate (77) or on the pipette tips (86) in the lower plate (77) according to one of alternative embodiments 22-33 and
- an upper plate (77), which is supported with the bottom side (80) on the top side (64) of the distance piece (56).

An alternative embodiment identified as embodiment 35 includes: The carrier according to alternative embodiment 34, in which several arrangements made up of distance piece (56) and plate (77) are stacked on top of each other.

An alternative embodiment identified as embodiment 36 includes: The carrier according to alternative embodiments 34 or 35, in which the upper plates (77) have on an apron-like, downwardly protruding edge area (82) inwardly protruding additional locking tabs (84) and the locking tabs (69 to 72) of the distance piece (56) are locked with the additional locking tabs (84).

An alternative embodiment identified as embodiment 37 includes: The carrier according to one of alternative embodiments 34-36, in which a hood-like cover (93) covering the pipette tips on the top and on the side is placed on the top on the uppermost plate (77).

An alternative embodiment identified as embodiment 38 includes: The carrier according to alternative embodiment 37, in which the plates (77) have an outwardly protruding, circumferential step (83) and the cover (93) is placed on the top side of the step (83) of the uppermost plate (77).

An alternative embodiment identified as embodiment 39 includes: The carrier according to one of alternative embodiments 34-38, which is surrounded by a strap (94) and/or is shrink-wrapped with a film.

An alternative embodiment identified as embodiment 40 includes: An arrangement made up of several carriers according to one of alternative embodiments 34-39, all of which are surrounded with a strap (94) and/or shrink-wrapped together with a film.

In the above description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

While the invention herein disclosed has been described by means of specific embodiments and applications thereof, numerous modifications and variations could be made thereto by those skilled in the art without departing from the scope of the invention set forth in the claims.

The invention claimed is:

1. A carrier for pipette tips comprising:

a frame or box having four side walls, lower and upper plates with a plurality of holes for inserting pipette tips, pipette tips inserted into the holes of the lower and upper plates, a circumferential edge protruding from the lower and upper plates and a circumferential resting edge on an upper edge of the frame or box defining locking elements for releasably connecting the frame or box with the lower plate, a distance piece formed from a single piece of material placed with a bottom side on the lower plate or on the pipette tips in the lower plate, wherein the upper plate is supported with the bottom side on a top side of the distance piece such that the distance piece holds the upper plate spaced from the lower plate, wherein the distance piece is frame-shaped, has sidewalls and an intermediate bottom with a plurality of additional holes for the lateral guiding of pipette tips held in the upper plate, the sidewalls protruding upwards from the intermediate bottom in order to support themselves on the bottom side of the upper plate, wherein the distance piece can be placed onto the bottom side of the upper plate with its top side outside of the holes of the upper plate, and wherein the distance piece can be placed with its bottom side onto the top side of the lower plate or of pipette tips held in the lower plate, wherein the distance piece ensures that each pipette tip is loosely inserted into another pipette tip held in the lower plate, each pipette tip held in the upper plate being laterally guided by said distance piece.

2. The carrier according to claim 1, wherein the distance piece side walls open toward a top such that several same distance pieces are stackable into each other.

3. The carrier according to claim 1, the distance piece having an upper edge, additional locking elements on the upper edge, the additional locking elements lockable with locking elements on the bottom side of the upper plate.

4. The carrier according to claim 3, wherein the additional locking elements comprise insertion chamfers protruding outwardly from at least two opposite distance piece side walls for locking behind locking edges on an apron-like downwardly protruding edge area of the upper plate.

5. The carrier according to claim 4, in which stiffening ribs are arranged between the additional locking elements and the distance piece side walls.

6. The carrier according to claim 1, in which the intermediate bottom of the distance piece bears ribs on the top side between the additional holes, which extend from a distance piece side wall to an opposite distance piece side wall.

7. The carrier according to claim 6, in which the ribs are intersecting ribs.

8. The carrier according to claim 1, which has guiding elements, at least one of the guiding elements protruding downwards from the intermediate bottom for the lateral guiding of pipette tips, which are held in the lower plate, or at least one of the guiding elements protruding upwards from the intermediate bottom for the lateral guiding of pipette tips, which are held in the upper plate, or at least one of the guiding elements protrudes downwards and at least one of the guiding elements protrudes upwards.

9. The carrier according to claim 1 comprising a plurality of distance pieces and a plurality of plates stacked on top of each other such that a distance piece is situated between consecutive plates.

10. The carrier according to claim 1, wherein the distance piece comprises additional locking elements, and wherein the upper plate has an apron-like, downwardly protruding edge area and inwardly protruding additional locking tabs, wherein the additional locking elements of the distance piece are locked with the additional locking tabs.

11. The carrier according to claim 1, in which a hood-like cover covering the pipette tips on the top and on the side is placed on the top of the uppermost plate.

12. The carrier according to claim 11, in which each of the plates has an outwardly protruding, circumferential step and the cover is situated on the top side of the step of the uppermost plate.

13. The carrier according to claim 1, which is surrounded by a strap and/or is shrink-wrapped with a film.

14. A carrier for pipette tips comprising:

a frame or box having four side walls, lower and upper plates with a plurality of holes for inserting pipette tips, pipette tips inserted into the holes of the lower and upper plates, a circumferential edge protruding from the lower and upper plates and a circumferential resting edge on an upper edge of the frame or box defining locking elements for releasably connecting the frame or box with the lower plate, a distance piece formed from a single piece of material placed with a bottom side on the lower plate or on the pipette tips in the lower plate, wherein the upper plate is supported with the bottom side on a top side of the distance piece such that the distance piece holds the upper plate spaced from the lower plate, wherein the distance piece is frame-shaped, has sidewalls and an intermediate bottom with a plurality of additional holes for the lateral guiding of pipette tips held in the upper plate, wherein the distance piece can be placed onto the bottom side of the upper plate with its top side outside of the holes of the upper plate, and wherein the distance piece can be placed with its bottom side onto the top side of the lower plate or of pipette tips held in the lower plate, wherein the distance piece ensures that each pipette tip is loosely inserted into another pipette tip held in the lower plate, each pipette tip held in the upper plate being laterally guided by said distance piece, which has guiding elements, at least one of the guiding elements protruding downwards from the intermediate bottom for the lateral guiding of pipette tips, which are held in the lower plate, or at least one of the guiding elements protruding upwards from the intermediate bottom for the lateral guiding of pipette tips, which are held in the upper plate, or at least one of the guiding elements protrudes downwards and at least one of the guiding elements protrudes upwards, in which the guiding elements of the distance piece comprise lower and upper sections of distance piece side walls, the side walls having an inside surface and an outside surface, which protrude in an apron-like manner downwards and upwards from the intermediate bottom in order to support themselves on the top side and the bottom side of the lower and upper plate, the pipette tips defining a periphery, the protruding sections of distance piece side walls being laterally supported on the pipette tips which are inserted near the edge into the plate on which the distance piece side walls are supported.

15. The carrier according to claim 14, in which the guiding elements protrude from the intermediate bottom side between the additional holes.

16. The carrier according to claim 15, in which the guiding elements are strip-like projections.

17. The carrier according to claim 15, in which the intermediate bottom is connected to the lower edge of the distance piece side walls.

* * * * *